US008156963B2

(12) United States Patent
Lopp et al.

(10) Patent No.: US 8,156,963 B2
(45) Date of Patent: Apr. 17, 2012

(54) FAUCET

(75) Inventors: Darren S. Lopp, North Ridgeville, OH (US); William E. Patton, Columbia Station, OH (US)

(73) Assignee: Moen Incorporated, North Olmsted, OH (US)

( * ) Notice: Subject to any disclaimer, the term of this patent is extended or adjusted under 35 U.S.C. 154(b) by 698 days.

(21) Appl. No.: 12/343,629

(22) Filed: Dec. 24, 2008

(65) Prior Publication Data

US 2010/0155505 A1 Jun. 24, 2010

(51) Int. Cl.
*E03C 1/04* (2006.01)

(52) U.S. Cl. ..... 137/801; 137/625.41

(58) Field of Classification Search ..... 137/801; 4/675–678

See application file for complete search history.

(56) References Cited

U.S. PATENT DOCUMENTS

| | | | | |
|---|---|---|---|---|
| 2,781,786 | A | 2/1957 | Young | |
| 3,448,768 | A | 6/1969 | Keller | |
| 3,556,140 | A | 1/1971 | Politz | |
| 3,590,876 | A | 7/1971 | Young | |
| 3,796,380 | A | 3/1974 | Johnson et al. | |
| 4,026,328 | A | 5/1977 | Nelson | |
| 4,103,709 | A | 8/1978 | Fischer | |
| 4,387,738 | A | 6/1983 | Bisonaya et al. | |
| 4,513,769 | A | 4/1985 | Purcell | |
| 4,649,958 | A | 3/1987 | Purcell | |
| 5,131,428 | A | 7/1992 | Bory | |
| 5,165,121 | A | 11/1992 | McTargett et al. | |
| 5,555,912 | A | 9/1996 | Saadi et al. | |
| 5,746,244 | A | 5/1998 | Woolley et al. | |
| 5,797,151 | A | 8/1998 | Ko | |
| 5,937,892 | A * | 8/1999 | Meisner et al. | 137/375 |
| 5,960,490 | A | 10/1999 | Pitsch | |
| 6,161,230 | A * | 12/2000 | Pitsch | 4/678 |
| 6,170,098 | B1 | 1/2001 | Pitsch | |
| 6,189,569 | B1 | 2/2001 | Calhoun | |
| 6,202,980 | B1 | 3/2001 | Vincent et al. | |
| 7,003,818 | B2 | 2/2006 | McNerney et al. | |
| 7,055,545 | B2 | 6/2006 | Mascari et al. | |
| 7,134,452 | B2 * | 11/2006 | Hiroshi et al. | 137/625.41 |
| 7,174,581 | B2 | 2/2007 | McNerney et al. | |
| 7,766,043 | B2 * | 8/2010 | Thomas et al. | 137/801 |
| 2003/0221254 | A1 | 12/2003 | McNerney et al. | |
| 2004/0117906 | A1 | 6/2004 | Baker et al. | |
| 2004/0154673 | A1 | 8/2004 | Mascari et al. | |
| 2005/0098221 | A1 | 5/2005 | Mascari et al. | |
| 2007/0271695 | A1 * | 11/2007 | Thomas et al. | 4/675 |

* cited by examiner

*Primary Examiner* — Craig Schneider

(74) *Attorney, Agent, or Firm* — Calfee, Halter & Griswold LLP

(57) ABSTRACT

A faucet includes a spout body formed by joining an upper body and a lower body to one another. A one-piece spout tube is secured to the upper body. For example, only a cartridge seat and an aerator of the faucet are used to hold the spout tube in the upper body. Water supply hoses connected to the cartridge seat bring hot and/or cold water from a water supply source to a valve cartridge interfaced with the cartridge seat. The water flows from the water supply source, through the water supply hoses, the cartridge seat, the valve cartridge, and the spout tube, and out the spout body through the aerator. The valve cartridge allows a user to control a flow rate and/or temperature of the water delivered through the spout tube and out the spout body.

15 Claims, 32 Drawing Sheets

SECTION A-A

SECTION A-A

SECTION B-B

SECTION C-C

SECTION A-A

SECTION A-A

SECTION C-C

FAUCET

FIELD

The general inventive concepts relate, among other things, to faucet assemblies and spout tubes for use therein and, more particularly, to a faucet assembly using a one-piece spout tube.

BACKGROUND

Some conventional faucets include a body formed from mating an upper shell and a lower shell. A waterway is formed in the body. The waterway is secured to the body using additional fasteners or structure. Water delivered to the faucet from a water supply source flows through the waterway and out the body. A valve assembly allows a user to control the flow rate and/or temperature of the water flowing through the waterway and out the body.

SUMMARY

A faucet, according to one exemplary embodiment, includes an upper shell and a lower shell. The upper shell and the lower shell can interface (e.g., be fastened together) to form a spout body. The faucet also includes a cartridge seat, an aerator, and a spout tube. The cartridge seat, the aerator, and the spout tube can all be secured in the upper shell. The spout tube can interface with (e.g., fit in) the cartridge seat so that the spout tube and the cartridge seat are in fluid communication. The spout tube can also interface with (e.g., receive a portion of) the aerator so that the spout tube and the aerator are in fluid communication. By securing both the cartridge seat and the aerator in the upper shell, the spout tube is also secured in the upper shell.

In one exemplary embodiment, the cartridge seat is a one-piece structure. The cartridge seat can include a recess for receiving a seal member (e.g., an O-ring). In one exemplary embodiment, the spout tube is a one-piece structure. The spout tube can include a recess for receiving a seal member (e.g., an O-ring).

A faucet assembly, according to one exemplary embodiment, includes an upper shell and a lower shell. The upper shell and the lower shell can interface (e.g., be fastened together) to form a spout body. The faucet also includes a cartridge seat, an aerator, and a spout tube. The cartridge seat, the aerator, and the spout tube can all be secured in the upper shell. The spout tube can interface with (e.g., fit in) the cartridge seat so that the spout tube and the cartridge seat are in fluid communication. The spout tube can also interface with (e.g., receive a portion of) the aerator so that the spout tube and the aerator are in fluid communication. By securing both the cartridge seat and the aerator in the upper shell, the spout tube is also secured in the upper shell. The faucet assembly also includes mounting components (e.g., a stud, a clamp, a nut) for securing the spout body to a mounting surface (e.g., a deck).

A one-piece spout tube, according to one exemplary embodiment, is disclosed. The one-piece spout tube is a hollow body having a straight portion at a first end and an annular flange at a second end, and a generally curved portion extending between the first end and the second end. In one exemplary embodiment, the one-piece spout tube includes a recess for receiving a seal member (e.g., an O-ring). In one exemplary embodiment, the one-piece spout tube is made entirely of plastic. In one exemplary embodiment, the one-piece spout tube is made using a gas-assisted molding process.

Numerous advantages and features will become readily apparent from the following detailed description of exemplary embodiments, from the claims and from the accompanying drawings.

BRIEF DESCRIPTION OF THE DRAWINGS

The general inventive concepts, as well as embodiments and advantages thereof, are described below in greater detail, by way of example, with reference to the drawings in which:

FIG. 1A is a perspective view of the faucet assembly. FIG. 1B is an exploded perspective view of the faucet assembly. FIG. 1C is a (front) side elevational view of the faucet assembly. FIG. 1D is a cross-sectional view of the faucet assembly of FIG. 1C, along line A-A.

FIG. 2A is a perspective view of the cartridge seat. FIG. 2B is a side elevational view of the cartridge seat. FIG. 2C is another side elevational view of the cartridge seat, rotated 180 degrees about a central axis relative to FIG. 2B. FIG. 2D is a bottom plan view of the cartridge seat. FIG. 2E is a top plan view of the cartridge seat. FIG. 2F is a cross-sectional view of the cartridge seat of FIG. 2C, along line A-A. FIG. 2G is a cross-sectional view of the cartridge seat of FIG. 2D, along line B-B. FIG. 2H is a cross-sectional view of the cartridge seat of FIG. 2E, along line C-C.

FIG. 6A is a perspective view of the upper member. FIG. 6B is a side elevational view of the upper member. FIG. 6C is another side elevational view of the upper member, rotated 180 degrees about a central axis relative to FIG. 6B. FIG. 6D is a bottom plan view of the upper member. FIG. 6E is a top plan view of the upper member. FIG. 6F is a cross-sectional view of the upper member of FIG. 6C, along line A-A. FIG. 6G is a cross-sectional view of the upper member of FIG. 6D, along line B-B. FIG. 6H is a cross-sectional view of the upper member of FIG. 6E, along line C-C.

FIG. 7A is a perspective view of the lower member. FIG. 7B is a side elevational view of the lower member. FIG. 7C is a top plan view of the lower member. FIG. 7D is a cross-sectional view of the lower member of FIG. 7C, along line A-A.

DETAILED DESCRIPTION

Figure 1A:
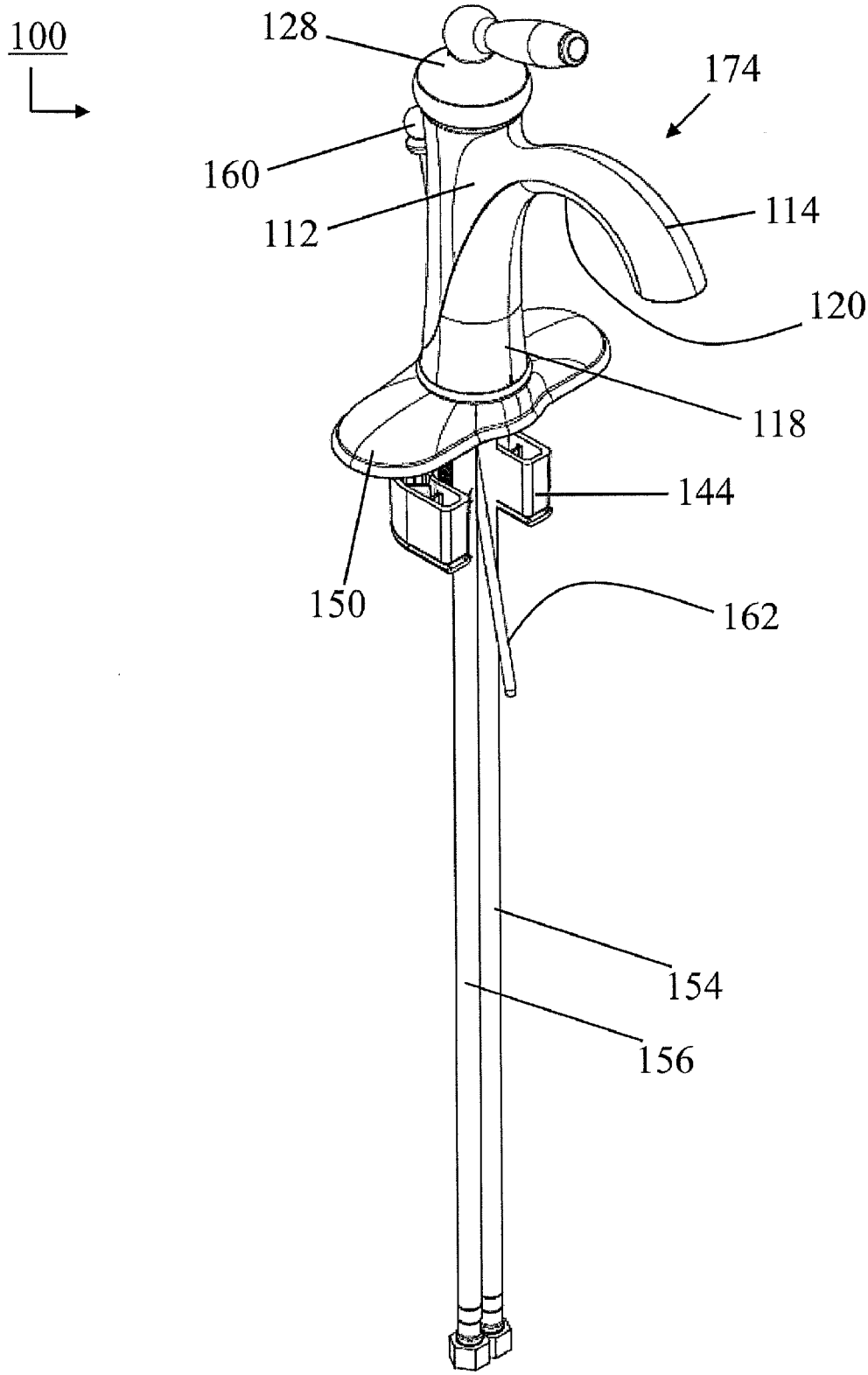
FIGS. 1A-1D show a faucet assembly, according to one exemplary embodiment.

While the general inventive concepts are susceptible of embodiment in many different forms, there are shown in the drawings and will be described herein in detail specific embodiments thereof with the understanding that the present disclosure is to be considered as an exemplification of the principles of the general inventive concepts. Accordingly, the general inventive concepts are not intended to be limited to the specific embodiments illustrated herein.

Referring to FIGS. 1A-1D, a one-handle faucet assembly 100, according to one exemplary embodiment, is shown. The faucet assembly 100 may provide increased reliability and/or ease of assembly. In one exemplary embodiment, the faucet assembly 100 realizes a reduction in manufacturing costs due to fewer parts being used and/or a reduction in material costs due to less expensive materials being used, as compared to conventional faucets.

Figure 1B:
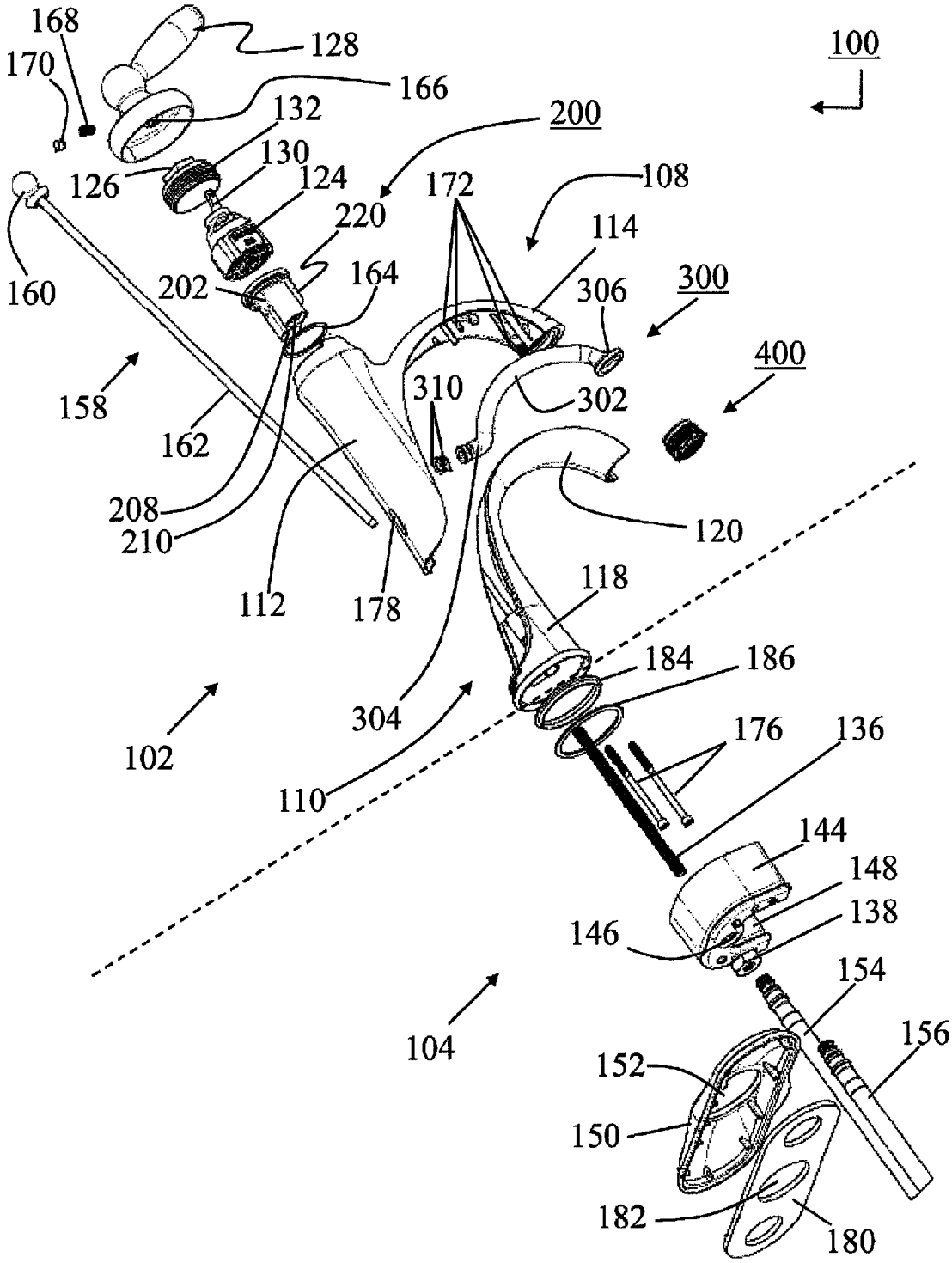

The faucet assembly 100 includes several discrete components (see FIG. 1B). Many of these components can be classified as faucet components 102 or mounting components 104. The faucet components 102 are directed, for example, to controlling a flow rate and/or a temperature of water delivered from a water supply source (not shown) and out through the faucet assembly 100. The mounting components 104 are directed, for example, to mounting the faucet assembly 100 to a mounting surface, such as a deck 106 (see FIGS. 1C-1D).

The faucet components 102 include a spout upper shell or body 108 and a spout lower shell or body 110. The spout upper body 108 and the spout lower body 110 can be made, for example, of metal and/or plastic. In one exemplary embodiment, the spout upper body 108 and the spout lower body 110 are made of zinc, using a die casting process. The spout upper body 108 has a generally cylindrical body 112 from which a curved portion 114 extends (see FIGS. 1B and 1D). The cylindrical body 112 of the spout upper body 108 defines an upper cavity 116. The spout lower body 110 also has a generally cylindrical body 118 from which a curved portion 120 extends. The cylindrical body 118 of the spout lower body 110 defines a lower cavity 122.

The faucet components 102 also include a cartridge seat 200 (see FIGS. 2A-2H). The cartridge seat 200 can be made, for example, of metal and/or plastic. In one exemplary embodiment, the cartridge seat 200 is a one-piece structure made of brass, using a forging process. Other cartridge seats can be made of two or more components. For example, as described below, a cartridge seat 500 for use in a faucet assembly, such as the faucet assembly 100, is a two-piece structure (see FIG. 5).

The cartridge seat 200 is a one-piece body 202 having an upper surface 204 and a lower surface 206. A lower cold water passage 208 and a lower hot water passage 210 both extend from the lower surface 206 of the body 202 toward the upper surface 204 of the body 202. The upper surface 204 of the body 202 includes an upper cold water passage 212 and an upper hot water passage 214, which are in fluid communication with the lower cold water passage 208 and the lower hot water passage 210, respectively. The upper surface 204 of the body 202 also includes a mixed water inlet passage 216 that is in fluid communication with a mixed water outlet passage 218 formed in a side surface 220 of the body 202.

The faucet components 102 also include a waterway 300 (see FIGS. 3A-3E). The waterway 300 is a one-piece, hollow body 302 having a generally straight portion 304 formed at one end and an annular flange 306 formed at the other end (see FIGS. 1B, 1D and 3A). A pair of grooves 308 for receiving O-rings 310 are formed on the straight portion 304. In one exemplary embodiment, the body 302 has a generally curved shape between the straight portion 304 and the annular flange 306. In one exemplary embodiment, the waterway 300 is a rigid tube made of plastic. In one exemplary embodiment, the waterway 300 is formed using a gas-assisted molding process.

Figure 4A:
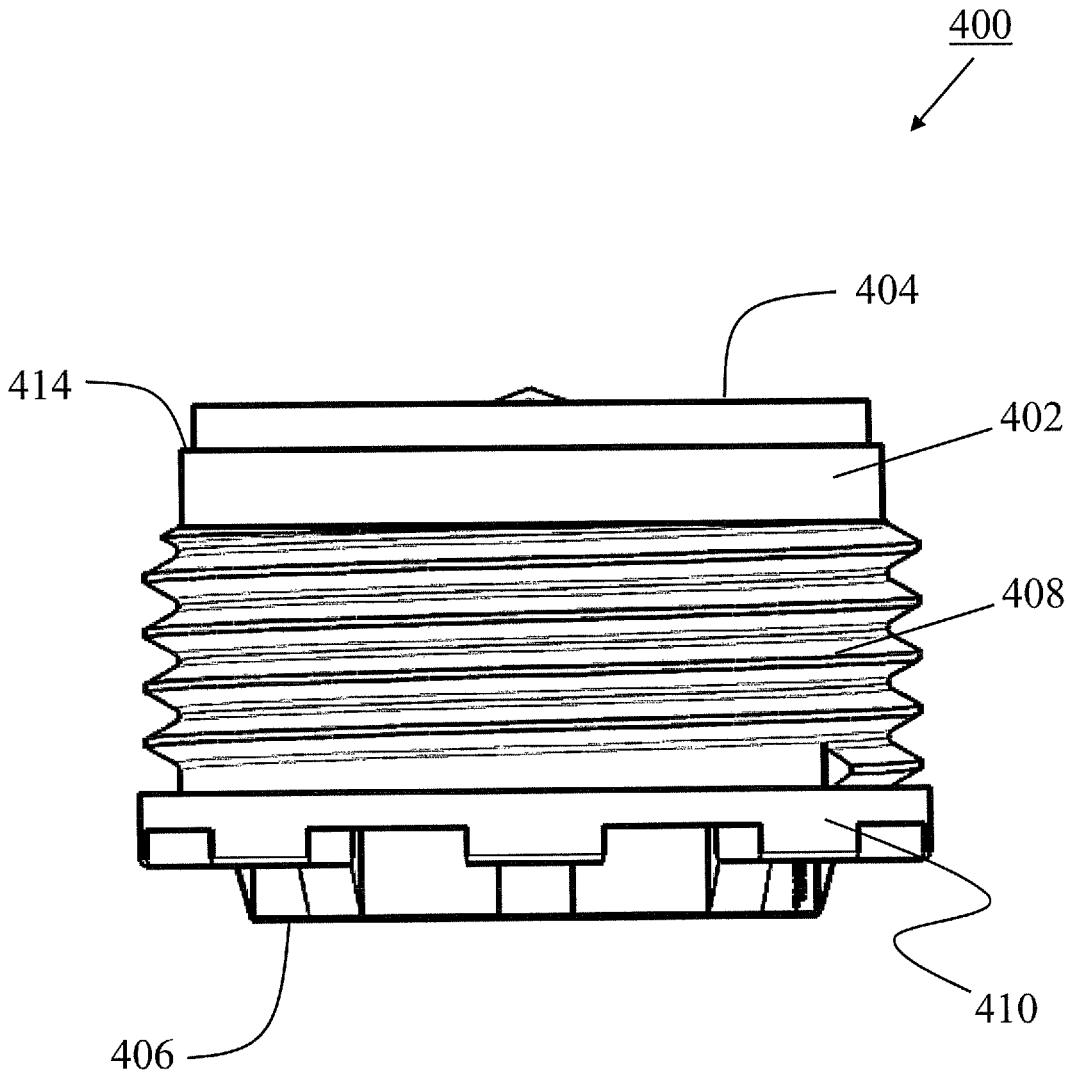
FIGS. 4A-4B show an aerator, according to one exemplary embodiment, for use in the faucet assembly shown in FIGS. 1A-1D.
Figure 4B:
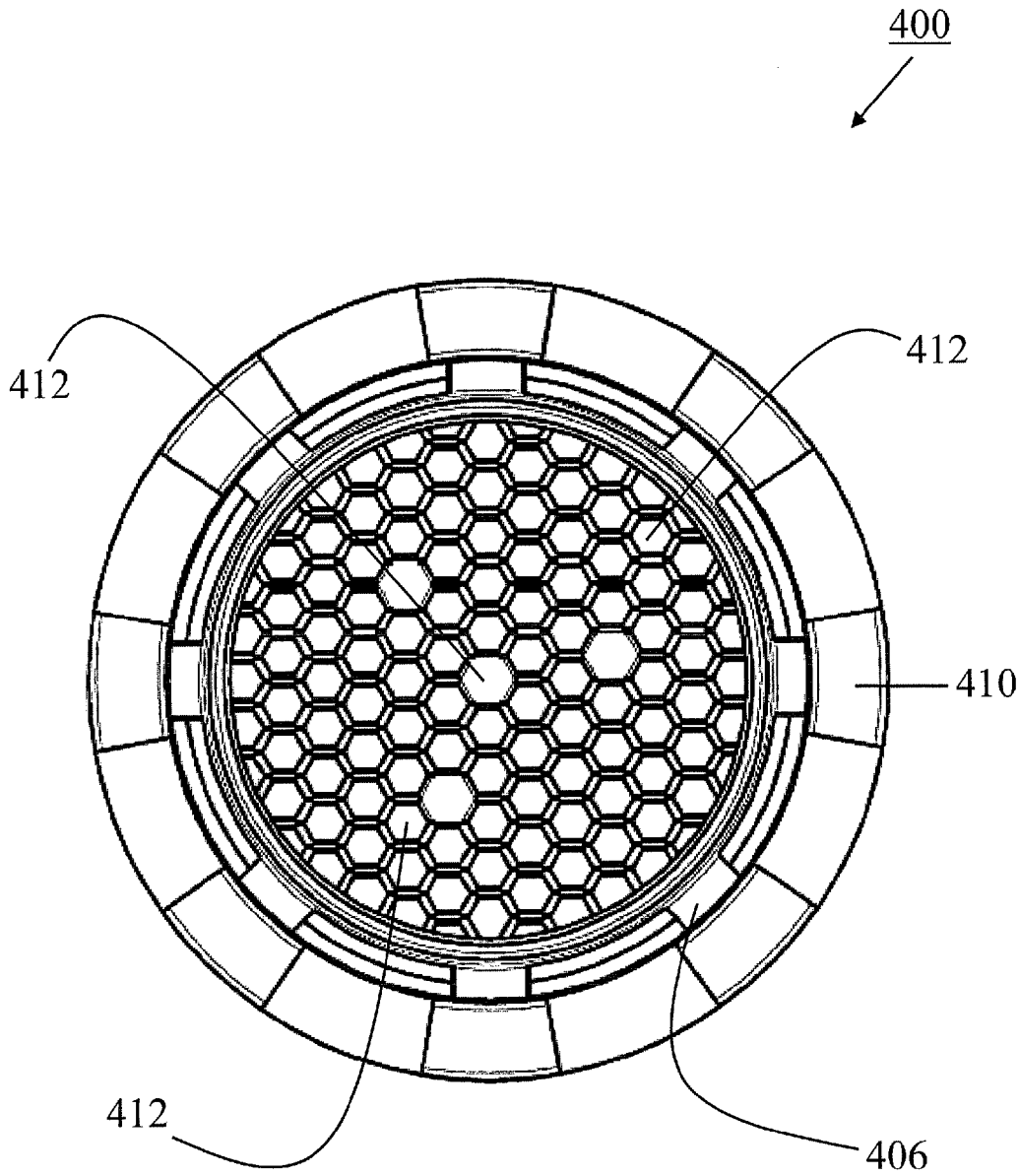

The faucet components 102 also include an aerator 400 (see FIGS. 4A-4B). The aerator 400 is a body 402 having an upper surface 404 and a lower surface 406. Threads 408 are formed on a portion of the body 402 between the upper surface 404 and the lower surface 406. A flange portion 410 is formed on the body 402 between the threads 408 and the lower surface 406. A plurality of openings 412 extend through the body 402. The openings 412 are shaped and/or sized to introduce air into water flowing through the aerator 400. A ledge 414 is formed on a portion of the body 402 between the threads 408 and the upper surface 404. The ledge 414 can support an O-ring 416 (see FIG. 1D). In one exemplary embodiment, the aerator 400 is made of plastic. In one exemplary embodiment, the aerator 400 is made using an injection-molded process.

The faucet components 102 also include a valve cartridge 124, a retention nut 126, and a handle 128. The valve cartridge 124 includes a stem 130, wherein movement of the stem 130 is translated into movement of a movable valve member (e.g., a disc) in the valve cartridge 124. The handle 128 can be made, for example, of metal and/or plastic. In one exemplary embodiment, the handle 128 is made of zinc, using a die casting process.

The retention nut 126 is a hollow body sized to fit around an upper portion of the valve cartridge 124. In one exemplary embodiment, the retention nut 126 bears down on a ledge formed on the valve cartridge 124. Threads 132 are formed on at least a portion of an outer surface of the retention nut 126 (see FIG. 1B). The threads 132 correspond to threads 134 formed on an inner surface of the cylindrical body 112 of the spout upper body 108 (see FIG. 1D). Accordingly, the retention nut 126 can be inserted into the upper cavity 116 of the cylindrical body 112 and screwed into the cylindrical body 112 of the spout upper body 108.

The mounting components 104 include a stud 136 and a nut 138. The stud 136 is a generally cylindrical shaft. Threads are formed on at least a portion of an outer surface of the stud 136. In one exemplary embodiment, the threads are formed along the entire length of the stud 136. The nut 138 includes threads that correspond to the threads on the stud 136, such that the nut 138 can be threaded onto the stud 136 (see FIG. 1D).

The mounting components 104 also include a clamp 144. The clamp 144 has an opening 146 extending through its length (see FIGS. 1B and 1D). The opening 146 is shaped and/or sized so that the stud 136 can fit through the opening 146 and extend through the clamp 144. In one exemplary embodiment, the clamp 144 has a generally C-shaped structure, where an empty area 148 is defined within the C-shape (see FIG. 1B).

The mounting components 104 include an escutcheon 150. The escutcheon 150 is an optional mounting component 104. For example, the escutcheon 150 can be used when the mounting surface (e.g., the deck 106) has three holes formed therein for mounting a hot water control member, a cold water control member, and a spout assembly, respectively. The escutcheon 150 is sized to cover the three holes and tapers up to an upper opening 152 formed in the escutcheon 150 (see FIG. 1B). In one exemplary embodiment, the upper opening 152 has a generally circular or oval shape. The shape of the upper opening 152 of the escutcheon 150 can correspond to a shape of the cylindrical body 118 of the spout lower body 110, such that the spout lower body 110 interfaces with (e.g., rests on) the escutcheon 150 in an aesthetically pleasing manner (see FIGS. 1A and 1D).

Figure 1C:
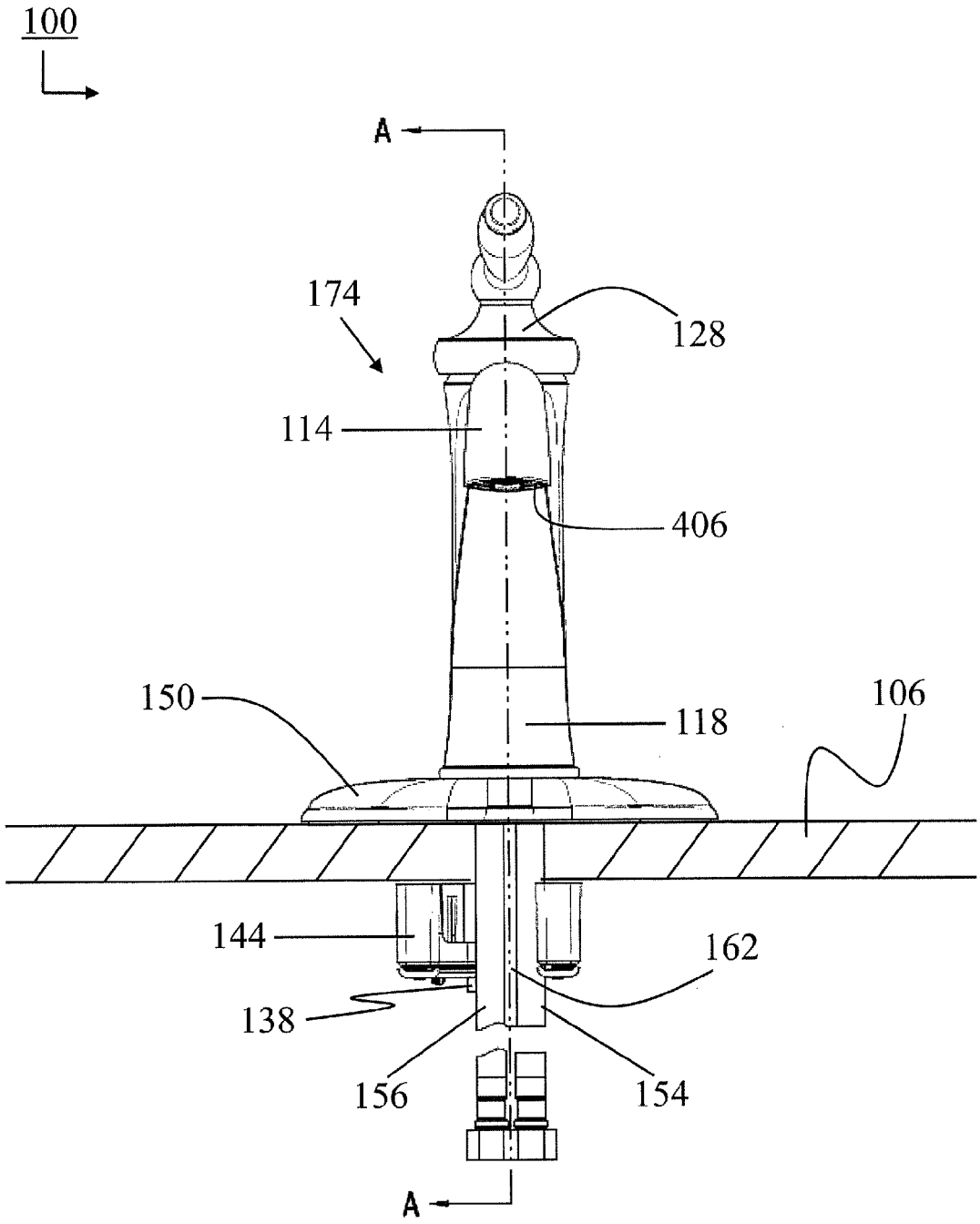

Other components of the faucet assembly 100 include a cold water supply hose 154 and a hot water supply hose 156 (see FIGS. 1A-1C). In one exemplary embodiment, the cold water supply hose 154 and the hot water supply hose 156 are flexible hoses made of plastic.

Figure 1D:
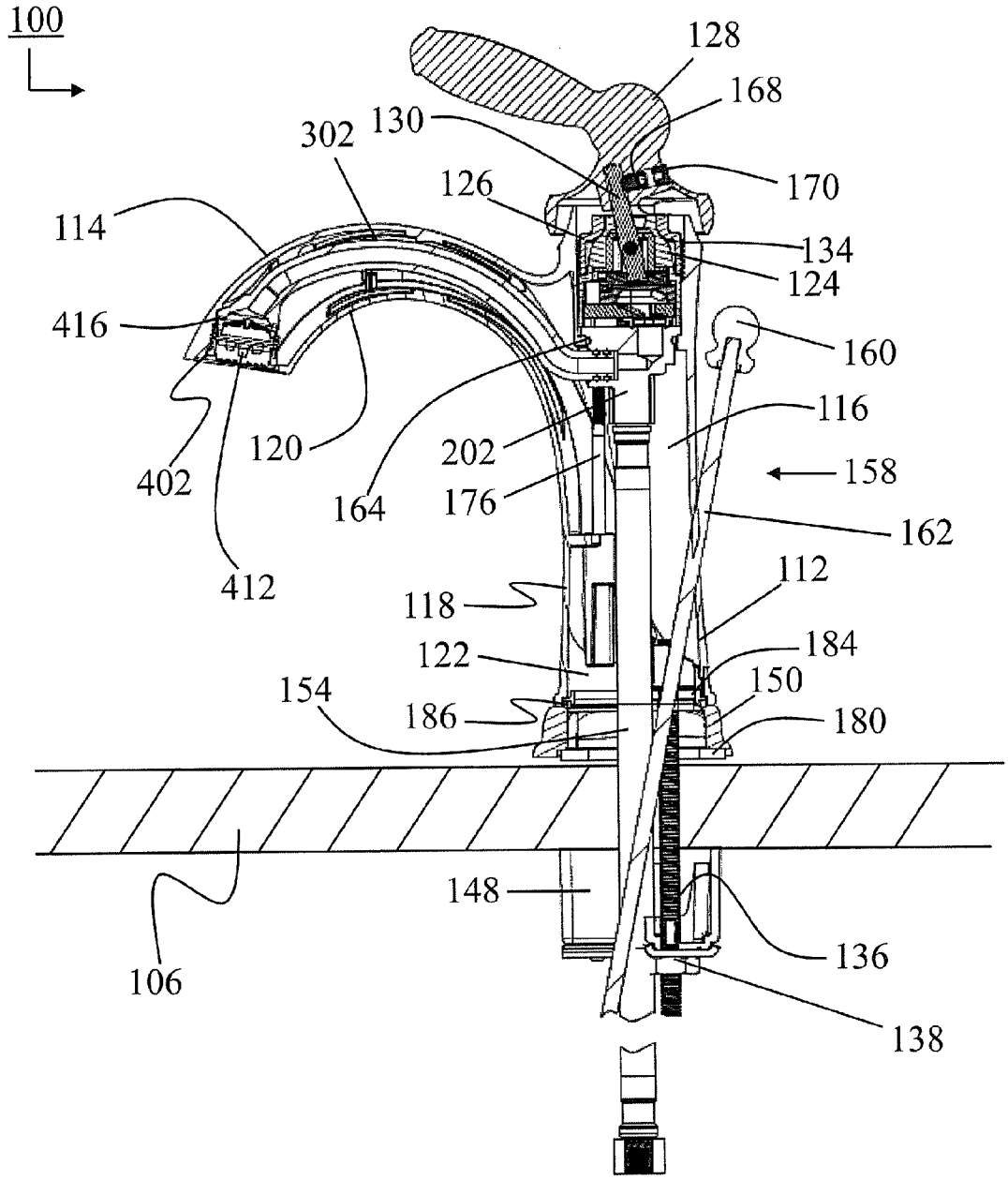
Figure 2A:
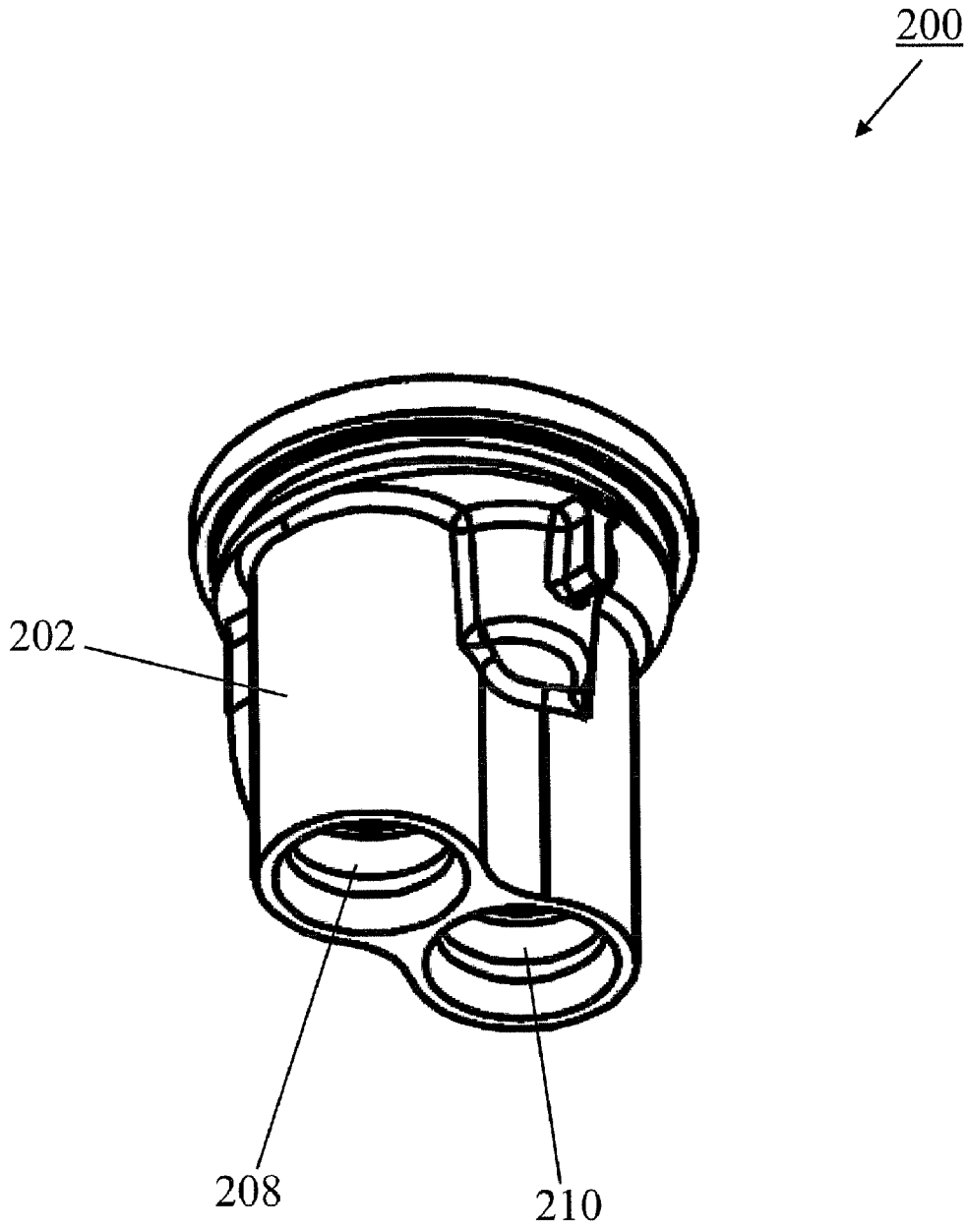
FIGS. 2A-2H show a one-piece cartridge seat, according to one exemplary embodiment, for use in the faucet assembly shown in FIGS. 1A-1D.
Figure 2B:
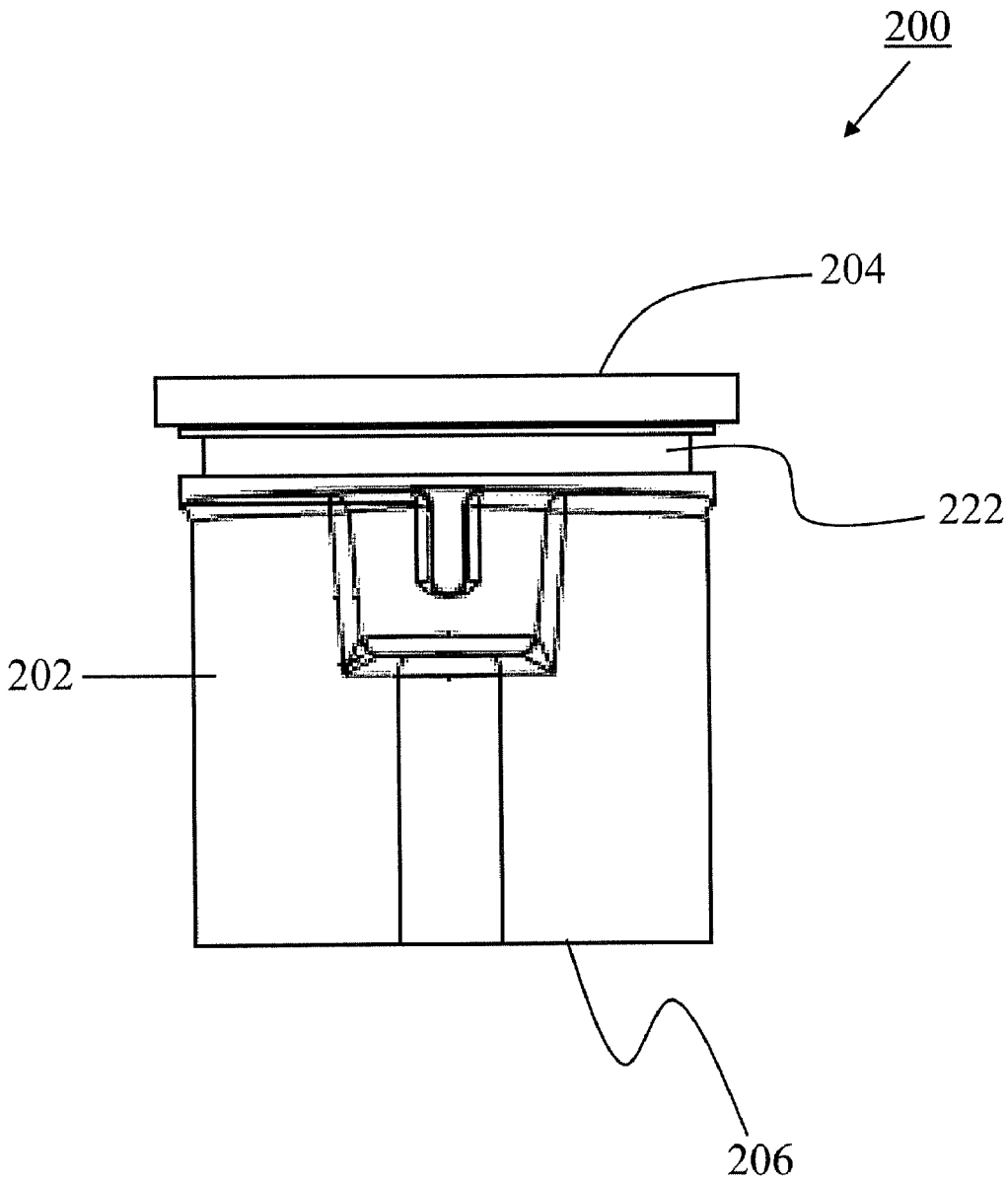
Figure 2C:
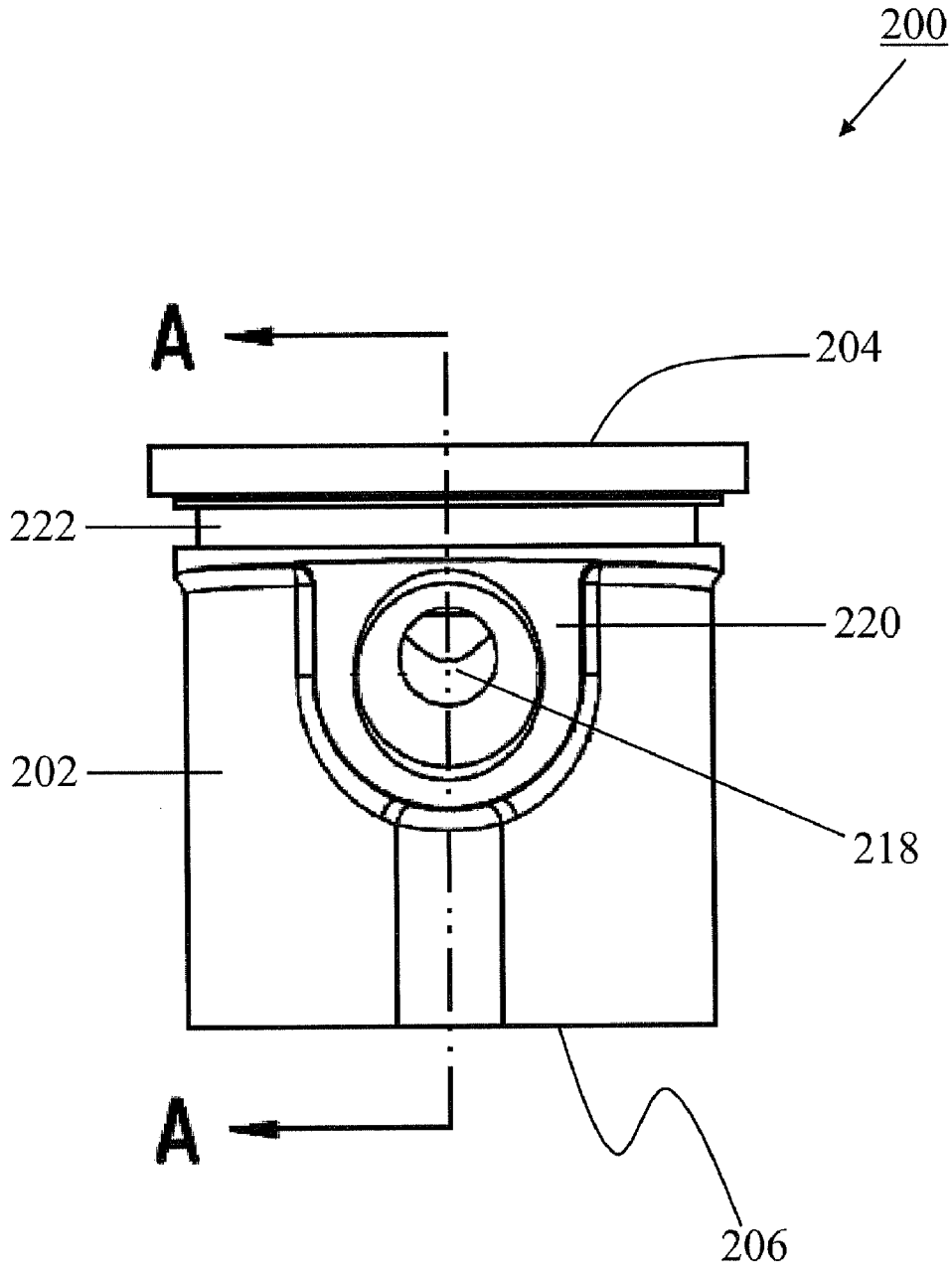
Figure 2D:
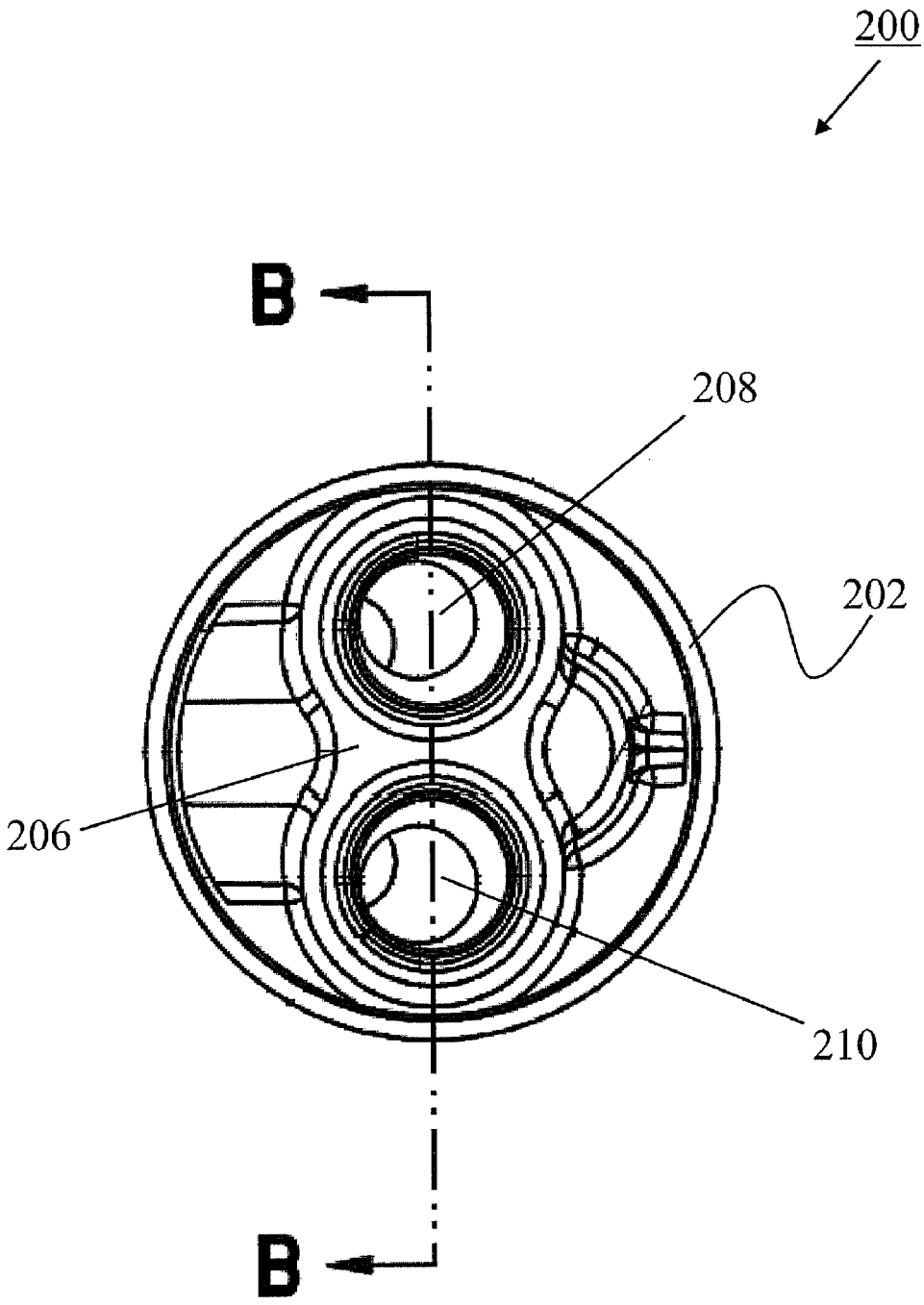
Figure 2E:
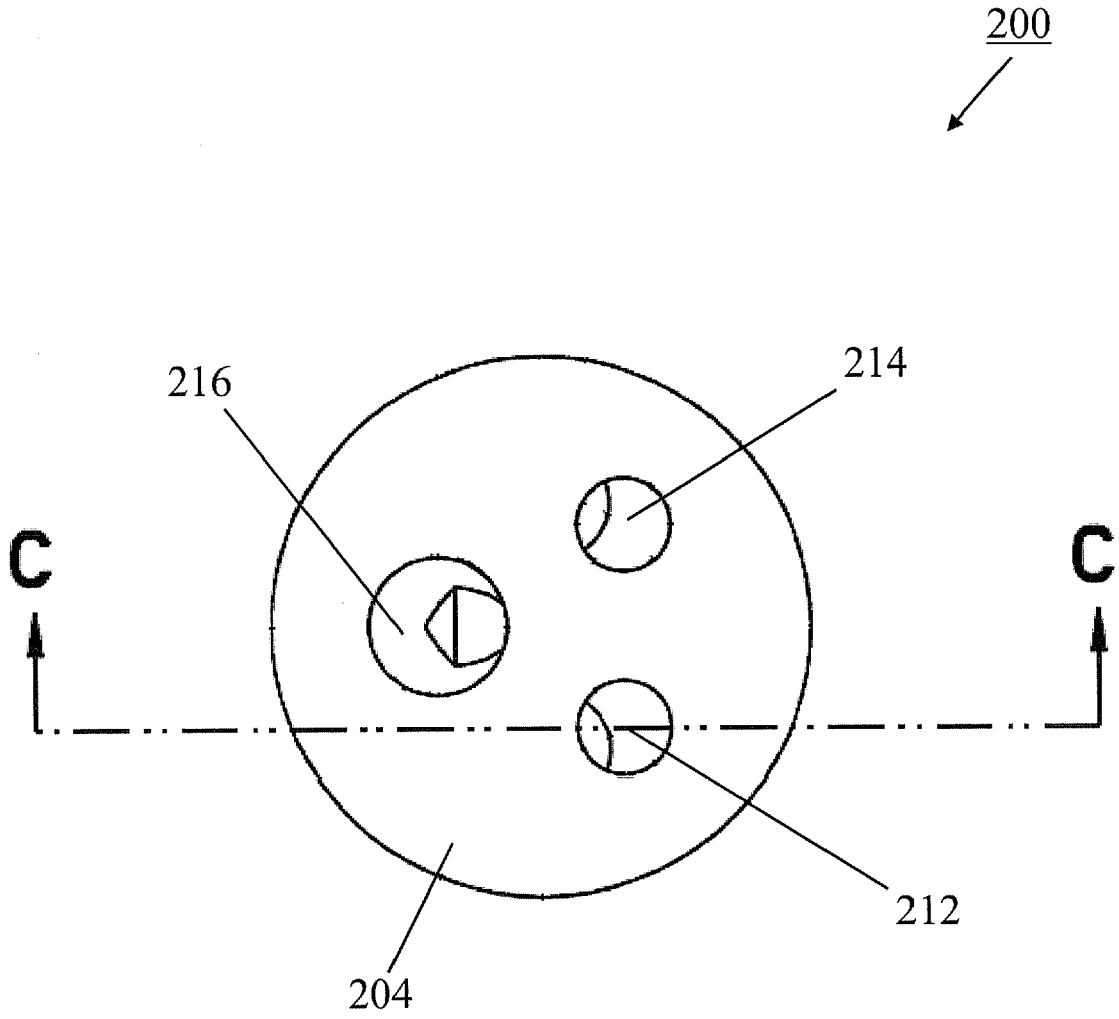
Figure 2F:
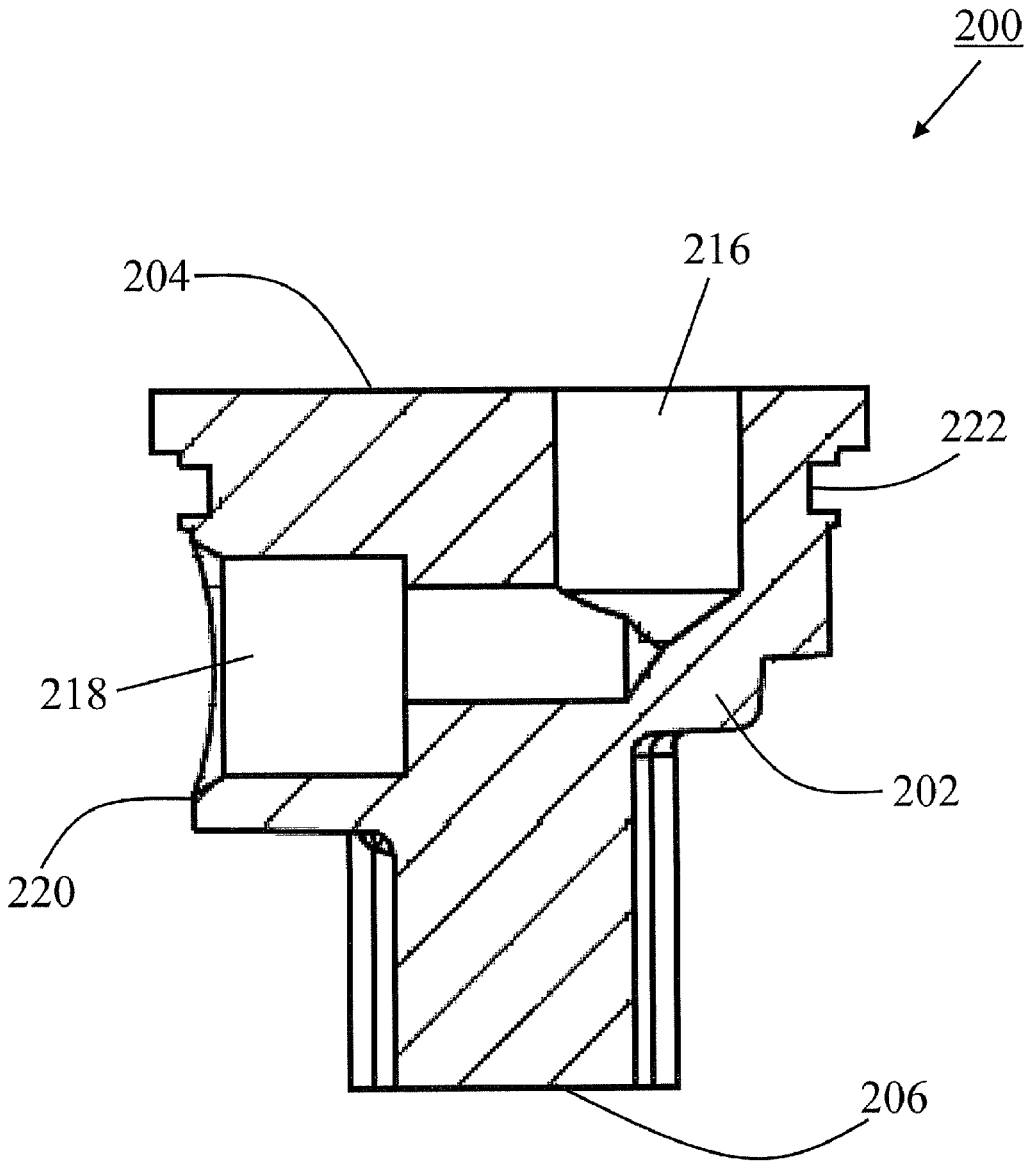
Figure 2G:
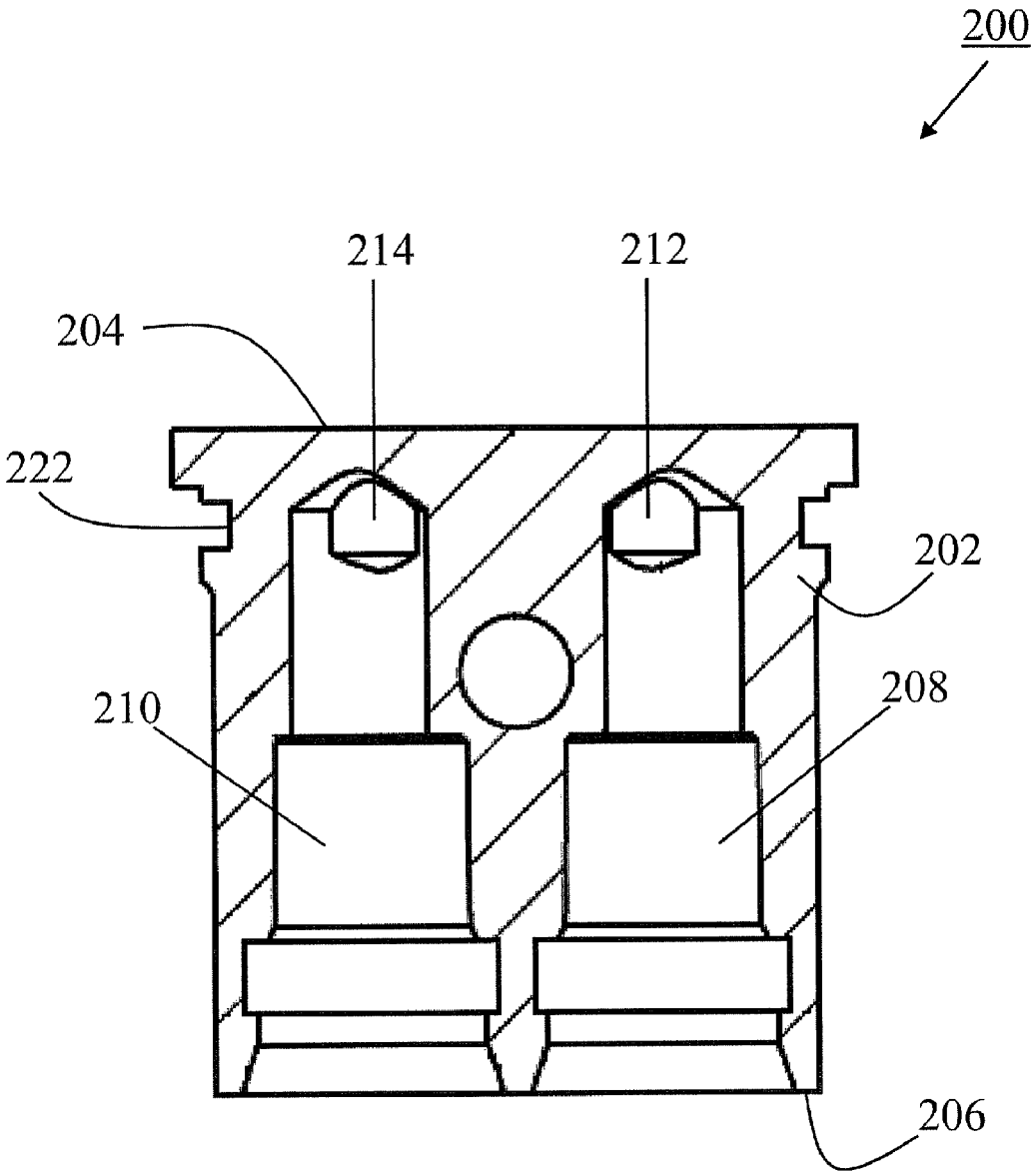
Figure 2H:
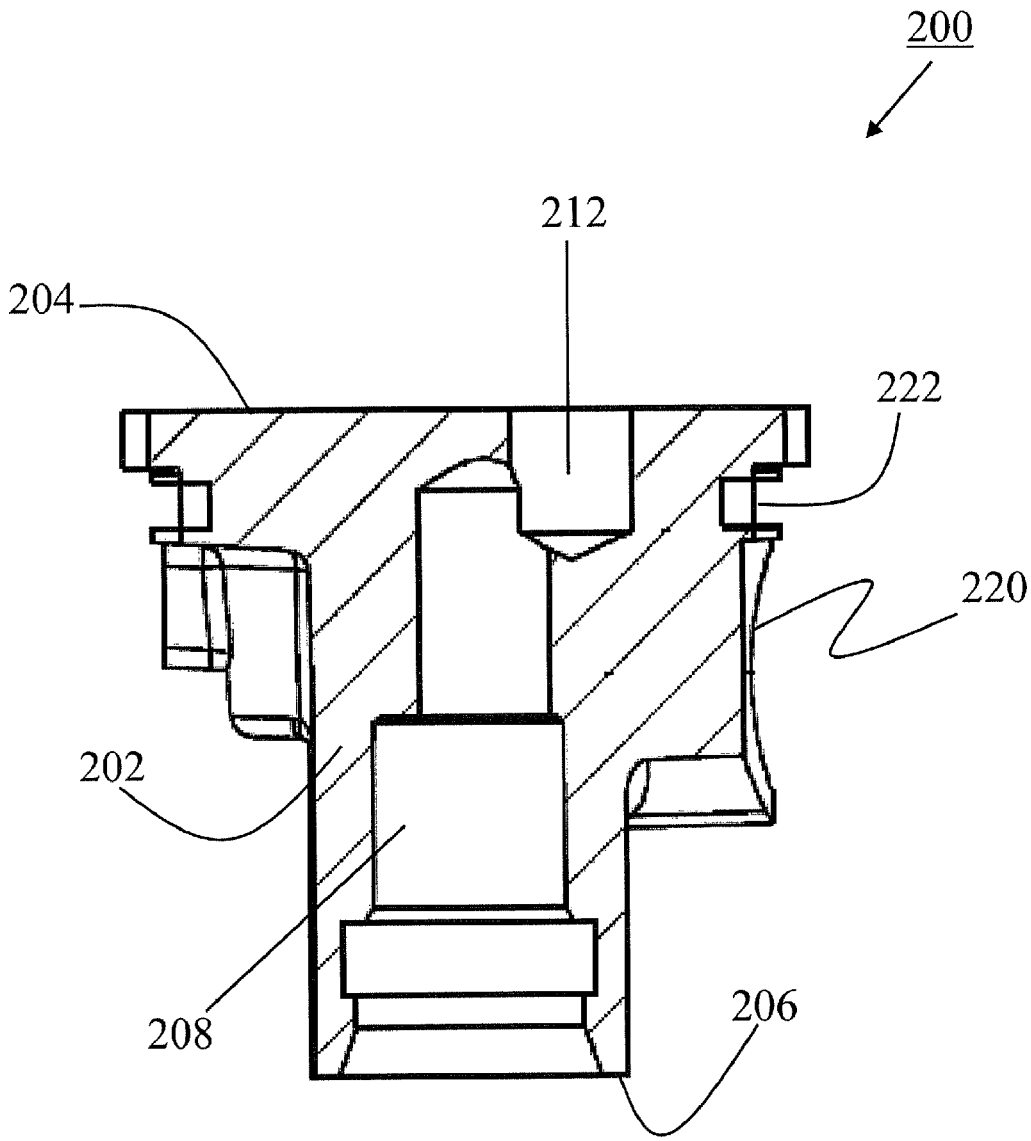
Figure 3A:
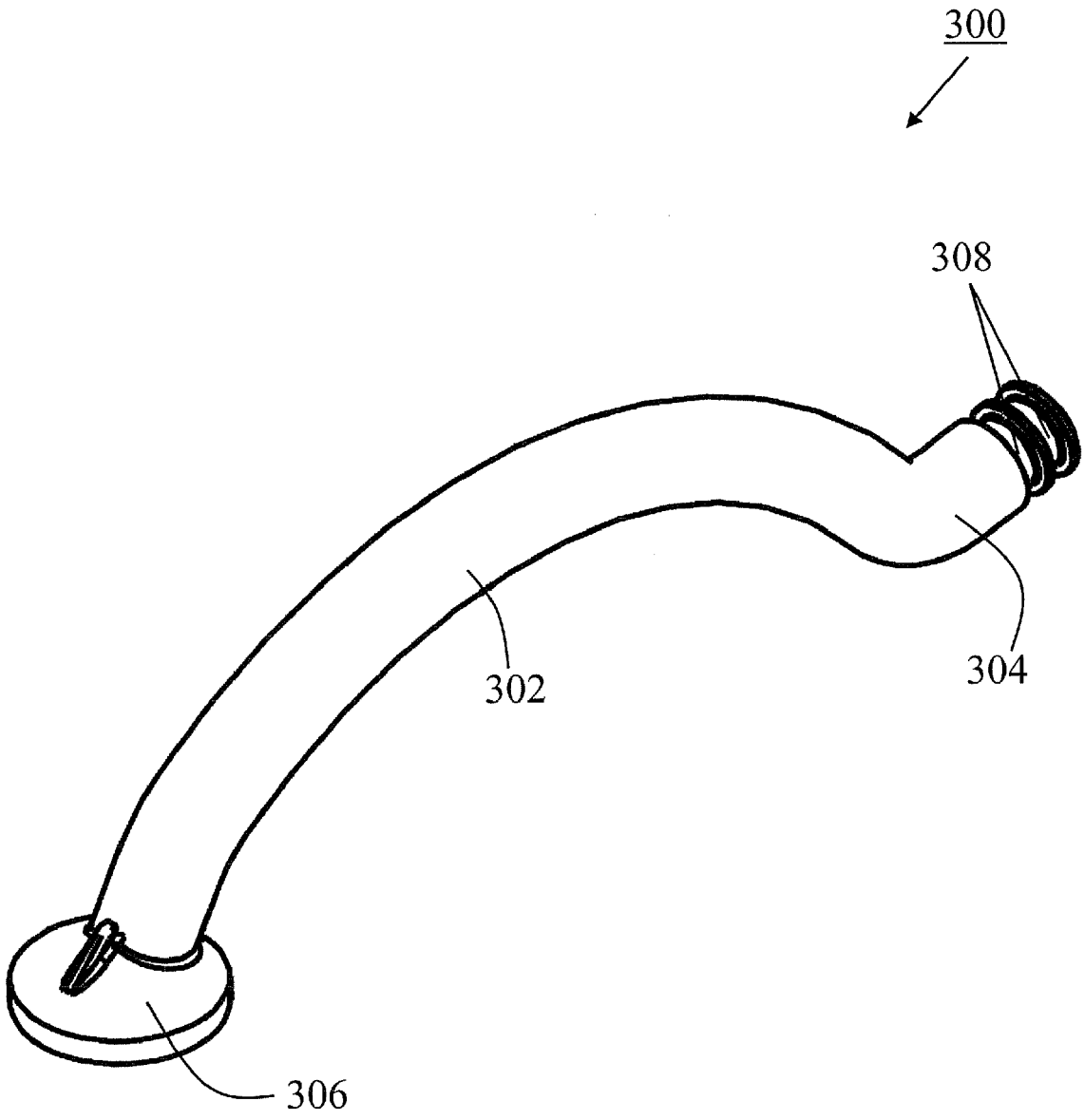
FIGS. 3A-3E show a waterway, according to one exemplary embodiment, for use in the faucet assembly shown in FIGS. 1A-1D.
Figure 3B:
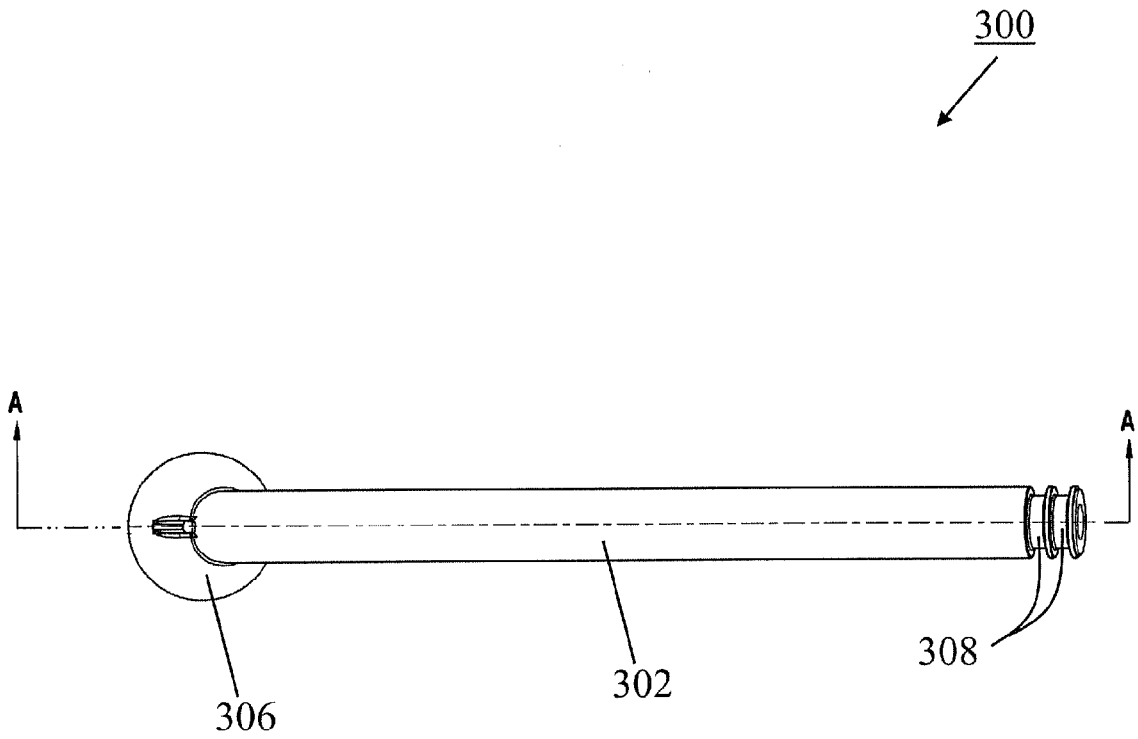
Figure 3C:
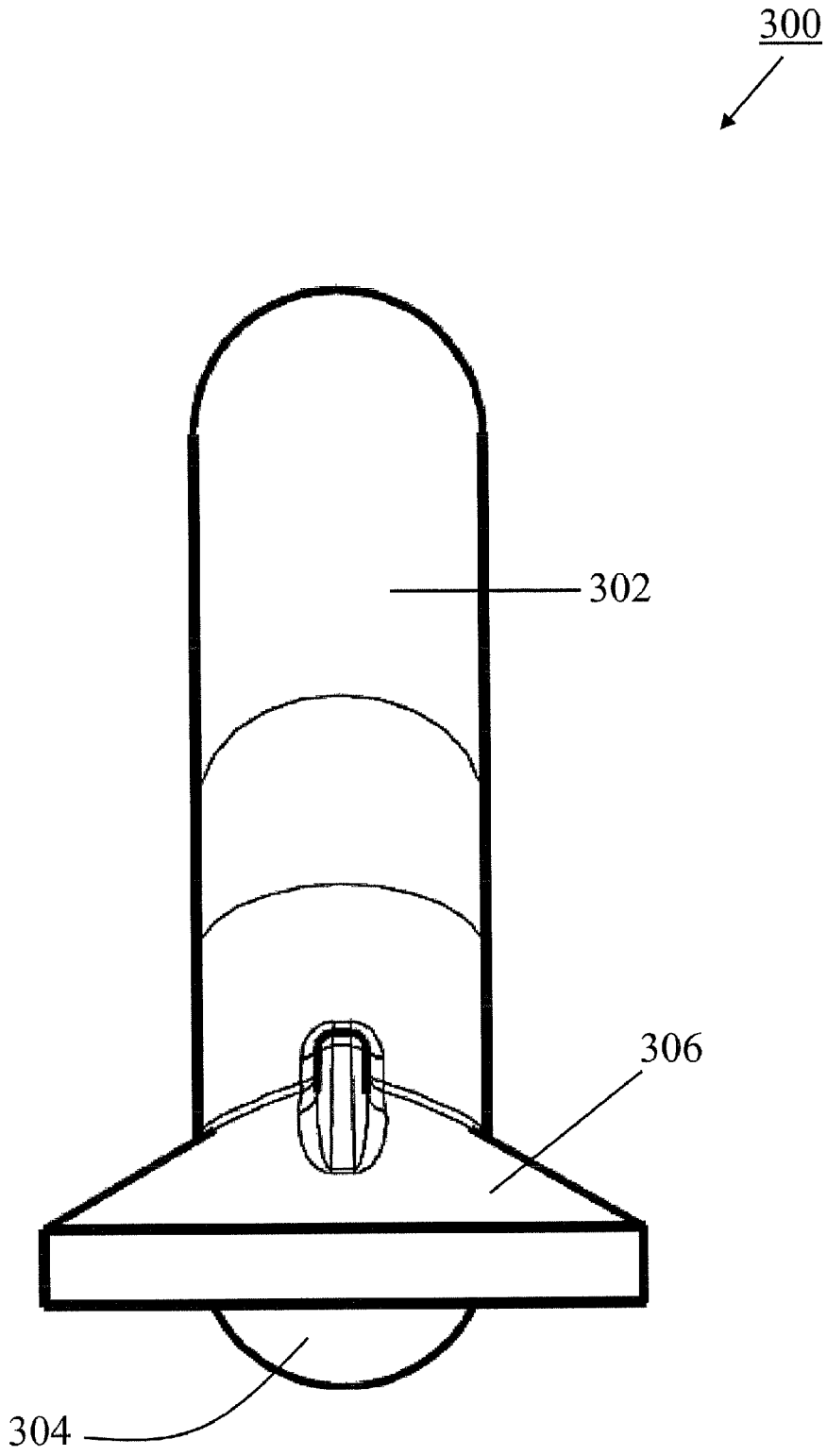
Figure 3D:
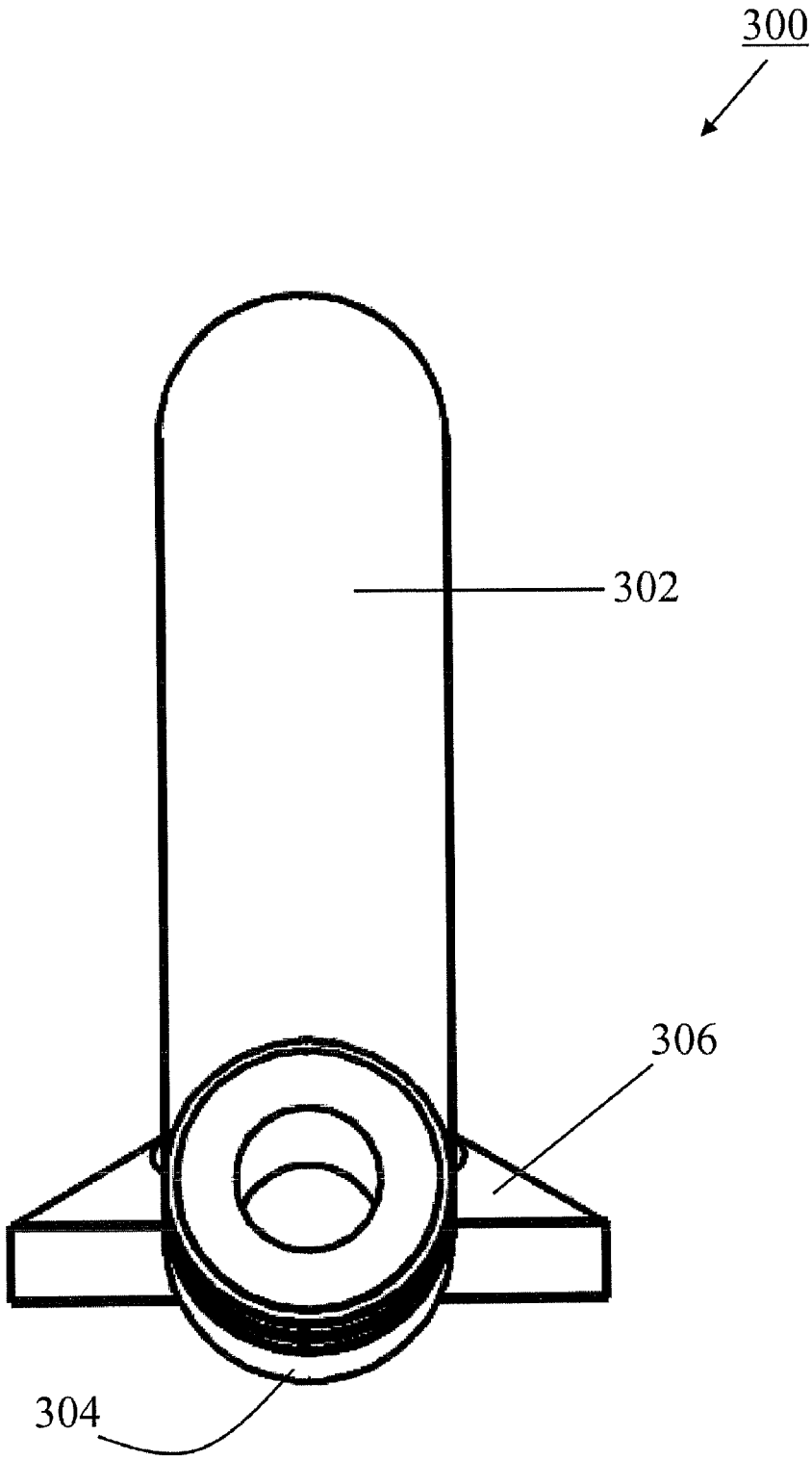
Figure 3E:
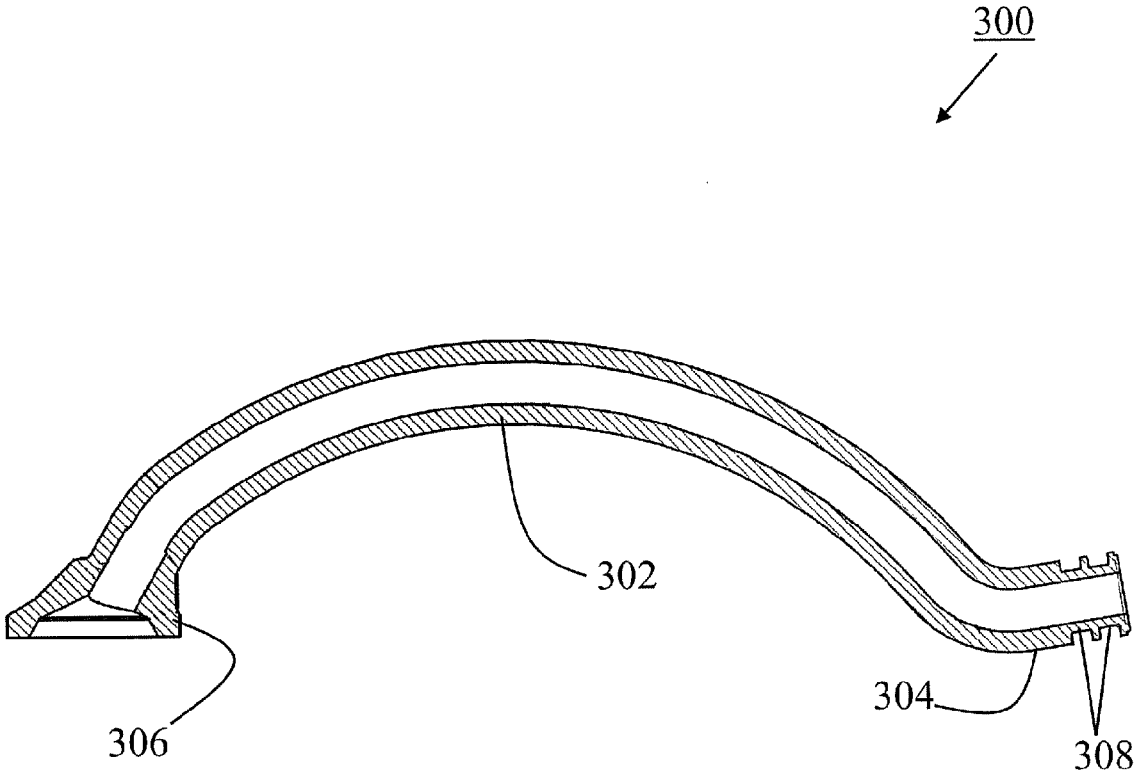

In one exemplary embodiment, the faucet assembly 100 also includes a lift rod assembly 158 (see FIGS. 1B and 1D). The lift rod assembly 158 includes a knob 160 and a shaft portion 162.

In assembling the faucet assembly 100, the cartridge seat 200 interfaces with the upper cavity 116 of the spout upper body 108. In one exemplary embodiment, the cartridge seat 200 is shaped and/or sized so as to interference or friction fit into the upper cavity 116. In one exemplary embodiment, the cartridge seat 200 snaps to the spout upper body 108. The cartridge seat 200 could also be formed integrally with the spout upper body 108.

In one exemplary embodiment, an O-ring 164 is disposed in a groove 222 below the upper surface 204 of the cartridge seat 200 (see FIG. 1D). This O-ring 164 increases reliability of the faucet assembly 100 by acting as a redundant seal to prevent water leaking below the deck 106 in the event that the valve cartridge 124 fails.

The valve cartridge 124 is then inserted in the upper cavity 116 of the spout upper body 108 so that it rests on the cartridge seat 200. The valve cartridge 124 can include structure (e.g., keys) that interface with corresponding structure (e.g., keyways) formed in a portion of the cylindrical body 112 surrounding the upper cavity 116 to insure that the valve cartridge 124 is properly oriented within the faucet assembly 100. The valve cartridge 124 regulates the flow rate and mixture ratio of cold water and hot water delivered from the water supply source. For example, manipulation of the stem 130 of the valve cartridge 124 about a first axis controls the flow rate of the water and about a second axis controls the temperature of the water. In one exemplary embodiment, the first axis and the second axis are perpendicular to one another.

A retaining member, such as the retention nut 126, interfaces with (e.g., is screwed into) the cylindrical body 112 of the spout upper body 108 to secure the valve cartridge 124 and the cartridge seat 200 in the spout upper body 108 (see FIGS. 1B and 1D). The retention nut 126 can also apply any necessary loading force to the valve cartridge 124.

The retention nut 126 has an annular shape so that a portion of the stem 130 of the valve cartridge 124 can extend through the retention nut 126 (see FIG. 1D). At least a part of that portion of the stem 130 extending through the retention nut 126 is received in a recess 166 formed inside an actuating mechanism, such as the handle 128 (see FIGS. 1B and 1D). This part of the stem 130 includes a notch. A set screw 168 is inserted through an opening in the handle 128 and engages the notch in the stem 130 to lock the handle 128 onto the stem 130 (see FIG. 1D). Thereafter, a plug 170 can be used to close the opening in the handle 128. The handle 128 facilitates manipulation of the stem 130 by a user.

Next, the waterway 300 interfaces with the cartridge seat 200. In particular, at least a portion of the straight portion 304 of the waterway 300 interfaces with (e.g., fits in) the mixed water outlet passage 218 of the cartridge seat 200 (see FIG. 1D). In one exemplary embodiment, the rigidness of the waterway 300 maintains the interface between the cartridge seat 200 and the waterway 300. In one exemplary embodiment, additional structure (e.g., a snap) on the cartridge seat 200 and/or the waterway 300 is used to maintain the interface between the cartridge seat 200 and the waterway 300. In one exemplary embodiment, the O-rings 310 situated in the grooves 308 of the straight portion 304 of the waterway 300 form a water tight seal between the waterway 300 and the cartridge seat 200.

The waterway 300 also interfaces with the spout upper body 108. For example, a shape of the waterway 300 generally corresponds to a shape of the curved portion 114 of the spout upper body 108 (see FIG. 1B). In one exemplary embodiment, prongs 172 extend from or are otherwise disposed on the curved portion 114 of the spout upper body 108 to provide structural support to the curved portion 114 of the spout upper body 108. The prongs 172 could also be used to assist in positioning and/or securing the waterway 300 relative to the spout upper body 108.

Furthermore, an end of the curved portion 114 of the spout upper body 108 is shaped and/or sized to interface with or otherwise accommodate the annular flange 306 of the waterway 300. In one exemplary embodiment, the annular flange 306 clearance fits into the end of the curved portion 114 of the spout upper body 108. In one exemplary embodiment, the annular flange 306 interference or friction fits into the end of the curved portion 114 of the spout upper body 108. In one exemplary embodiment, the annular flange 306 snaps to the end of the curved portion 114 of the spout upper body 108.

The aerator 400 then interfaces with (e.g., screws into) the end of the curved portion 114 of the spout upper body 108. Accordingly, the aerator 400 can further secure the waterway 300 in the spout upper body 108. The O-ring 416 on the aerator 400 forms a water tight seal between the waterway 300 and the aerator 400.

One end of the cold water supply hose 154 extends through the cavity 122 of the spout lower body 110 and into the cavity 116 of the spout upper body 108 to interface with (e.g., fit in) the lower cold water passage 208 of the cartridge seat 200. Likewise, one end of the hot water supply hose 156 extends through the cavity 122 and into the cavity 116 to interface with (e.g., fit in) the lower hot water passage 210 of the cartridge seat 200. In one exemplary embodiment, the water supply hoses 154 and 156 snap fit into the cartridge seat 200.

Once the water supply hoses 154 and 156 are interfaced with the cartridge seat 200, the spout lower body 110 interfaces with (e.g., is connected to) the spout upper body 108 to form a spout body 174 (see FIGS. 1A and 1C). In one exemplary embodiment, screws 176 are used to secure the spout lower body 110 to the spout upper body 108.

If not done beforehand, the shaft portion 162 of the lift rod assembly 158 can be inserted through an opening 178 in the spout lower body 110 (see FIGS. 1B and 1D). A lower end of the shaft portion 162 can fit between the cold water supply hose 154 and the hot water supply hose 156 interfaced with the cartridge seat 200 (see FIGS. 1A and 1C).

In one exemplary embodiment, the spout body 174, having the handle 128 secured thereto and the valve cartridge 124, cartridge seat 200, waterway 300 and aerator 400 secured therein, is then mounted to the deck 106. In one exemplary embodiment, the spout lower body 110 is mounted to the deck 106 prior to the spout lower body 110 interfacing with the spout upper body 108 to form the spout body 174.

If the escutcheon 150 is used to mount the spout body 174, an escutcheon gasket 180 is placed on the deck 106, such that at least one opening 182 extending through the escutcheon gasket 180 is disposed over a hole in the deck 106. In one exemplary embodiment, an adhesive is used to affix the escutcheon gasket 180 to the deck 106. The escutcheon 150 is disposed on, and either completely or mostly covers, the escutcheon gasket 180. The upper opening 152 of the escutcheon 150 is at least partially aligned with the opening 182 of the escutcheon gasket 180. The spout body 174 is then disposed on the escutcheon 150, such that the spout lower body 110 is aligned with the upper opening 152 of the escutcheon 150. A spout gasket 184 is positioned between the spout body 174 and the escutcheon 150 (see FIG. 1D). The spout gasket 184 is an annular body with a shape that corresponds to the shape of the cylindrical body 118 of the spout lower body 110 and/or the upper opening 152 of the escutcheon 150. An O-ring 186 interfaces with (e.g., fits around) the spout gasket 184 to form a water tight seal between the spout body 174 and the escutcheon 150. With the spout body 174 resting on the escutcheon 150, the lower end of the shaft portion 162 of the lift rod assembly 158, and the water supply hoses 154 and 156, extend through the escutcheon 150 and the hole in the deck 106 (see FIGS. 1A and 1C-1D).

If the escutcheon 150 is not used to mount the spout body 174, the spout body 174 is mounted directly on the deck 106. In this case, the spout lower body 110 is at least partially aligned with or otherwise disposed over the hole in the deck 106. The spout gasket 184 is positioned between the spout body 174 and the deck 106. The O-ring 186 interfaced with the spout gasket 184 forms a water tight seal between the spout body 174 and the deck 106. With the spout body 174 resting on the deck 106, the lower end of the shaft portion 162 of the lift rod assembly 158, and the water supply hoses 154 and 156, extend through the hole in the deck 106.

In one exemplary embodiment, if the faucet assembly 100 is being mounted for use with a vessel-type sink, one or more extensions (not shown) can be inserted between the spout body 174 and the deck 106, such that a height of the faucet assembly 100 is appropriate for the sink.

The clamp 144 is positioned below the deck 106, such that the opening 146 in the clamp 144 is at least partially aligned with the hole in the deck 106. The empty area 148 of the clamp 144 fits around the shaft portion 162 of the lift rod assembly 158, and the water supply hoses 154 and 156, extending through the deck 106.

The stud 136 is inserted through the opening 146 in the clamp and the hole in the deck 106. A portion of the stud 136 extending above the deck 106 and into the cavity 122 of the spout lower body 110 interfaces with (e.g., is screwed into) the spout body 174. The nut 138 is screwed onto a portion of the stud 136 extending below the deck 106 and the clamp 144. As the nut 138 is screwed onto the stud 136, the spout body 174 is pulled down against an upper surface of the deck 106 and the clamp 144 is pushed up against a lower surface of the deck 106. In this manner, the spout body 174 is securely mounted to the deck 106.

The lower end of the shaft portion 162 of the lift rod assembly 158 extends through the hole in the deck 106 and engages a stopper (not shown) for a drain (e.g., a sink drain). Movement of the lift rod assembly 158 (e.g., the knob 160) up and down causes the stopper to move between an opened and a closed position.

The cold water supply hose 154 and the hot water supply hose 156 operate to connect the water supply source to the faucet assembly 100. For example, another end of the cold water supply hose 154 (i.e., opposite the end interfaced with the cartridge seat 200) extends through the hole in the deck 106 and interfaces with (e.g., is connected to) a cold water supply pipe located under the deck 106. Likewise, another end of the hot water supply hose 156 (i.e., opposite the end interfaced with the cartridge seat 200) extends through the hole in the deck 106 and interfaces with (e.g., is connected to) a hot water supply pipe located under the deck 106. The cold water supply hose 154 and the hot water supply hose 156 deliver cold and hot water, respectively, from the water supply source to the faucet assembly 100.

The handle 128 allows a user to control the flow rate and/or temperature of the water flowing through the faucet assembly 100. The water flows from the water supply source, through the water supply hoses 154 and 156, the cartridge seat 200, the valve cartridge 124, and the waterway 300, and out the spout body 174 through the aerator 400, which defines a water flow path. Furthermore, all of these water flow components (i.e., the water supply hoses 154 and 156, the cartridge seat 200, the valve cartridge 124, the waterway 300, and the aerator 400) are mounted to the spout upper body 108 only, and not to the spout lower body 110.

As noted above, in one exemplary embodiment, the faucet assembly 100 uses a multi-piece cartridge seat, such as the cartridge seat 500 (see FIG. 5), instead of the one-piece cartridge seat 200. The multi-piece cartridge seat may provide increased strength and/or moldability, as compared to a one-piece cartridge seat.

Figure 5:
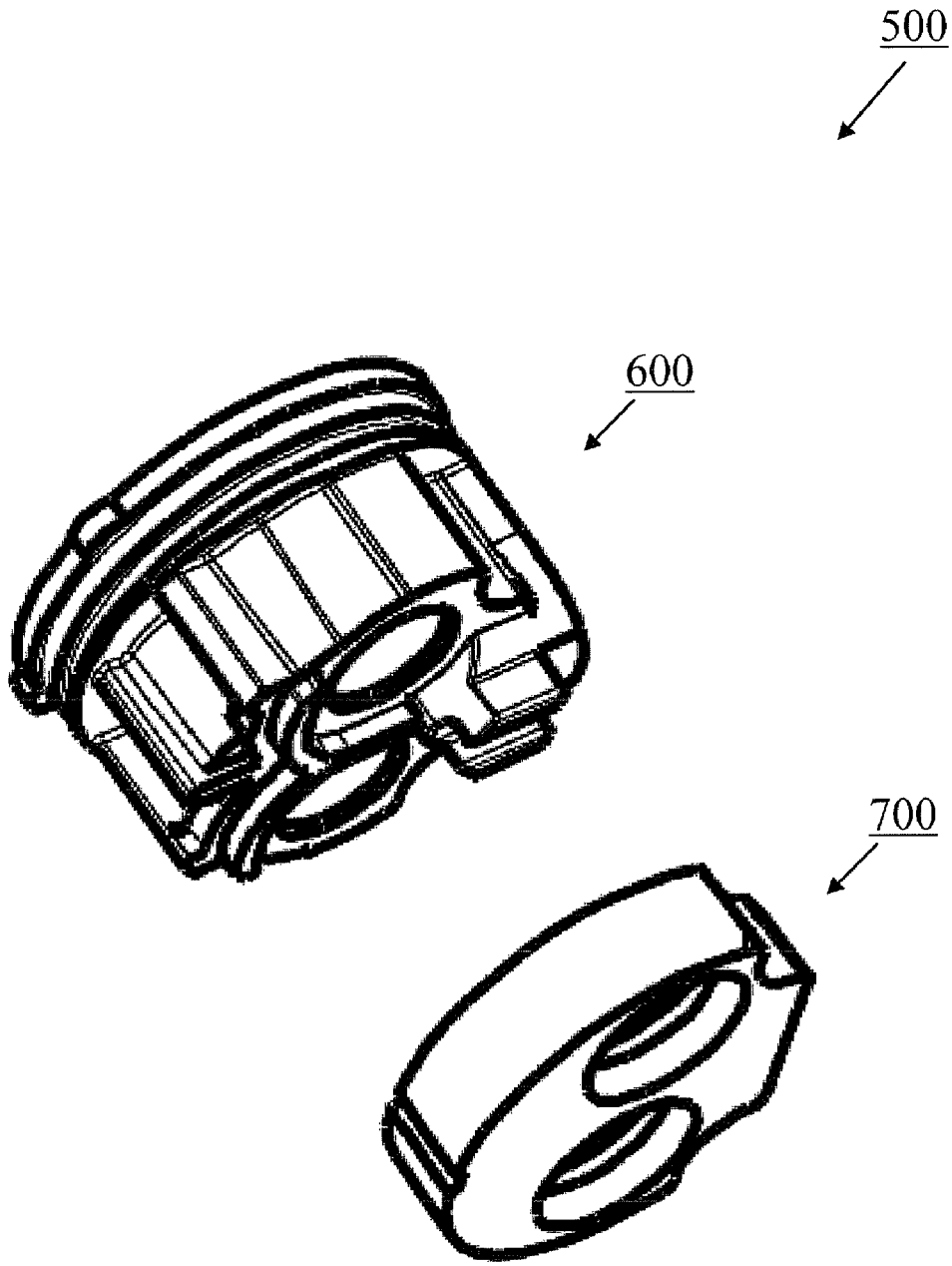
FIG. 5 shows a two-piece cartridge seat, according to one exemplary embodiment, for use in the faucet assembly shown in FIGS. 1A-1D.
Figure 6A:
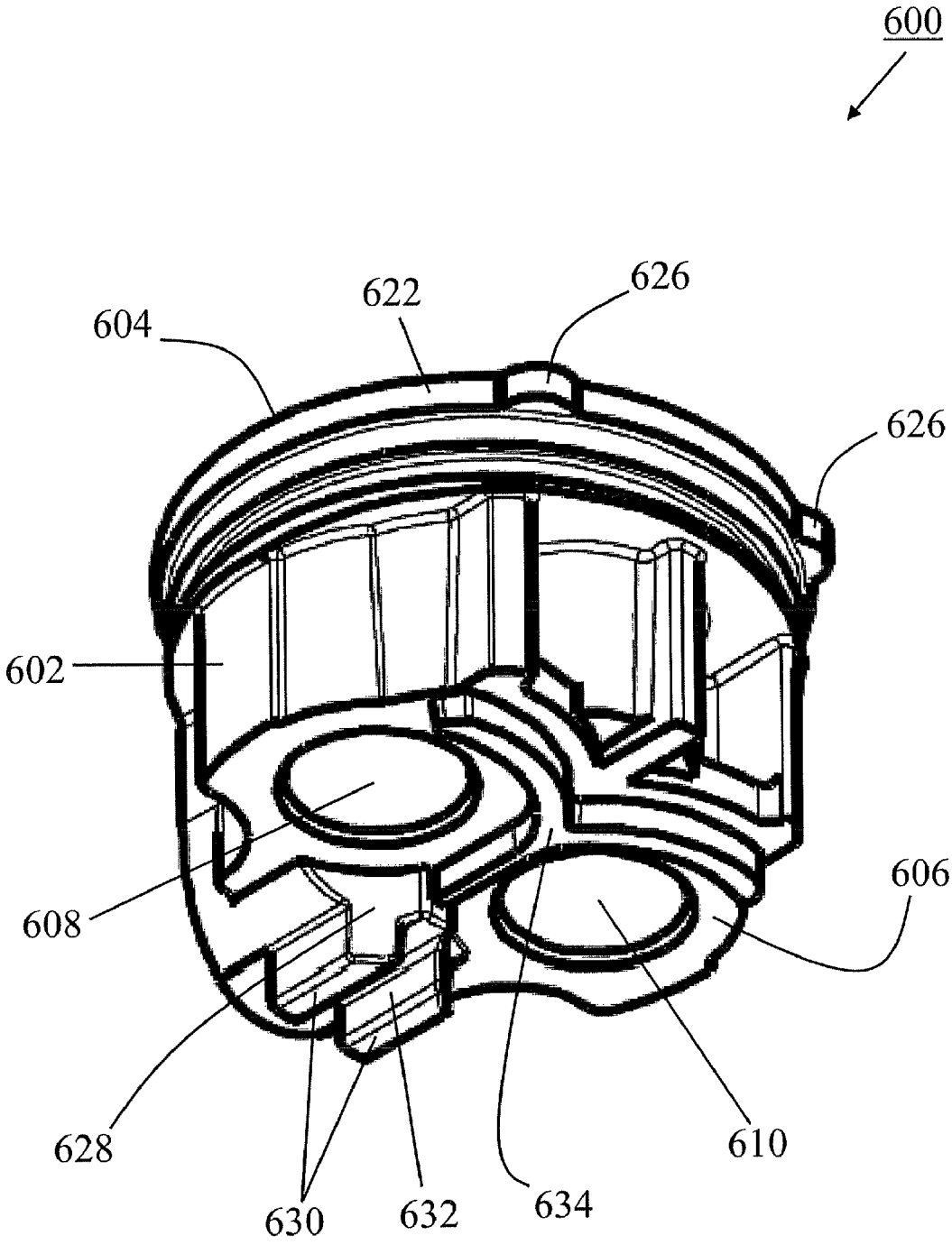
FIGS. 6A-6H show an upper member, according to one exemplary embodiment, for use in the cartridge seat shown in FIG. 5.
Figure 6B:
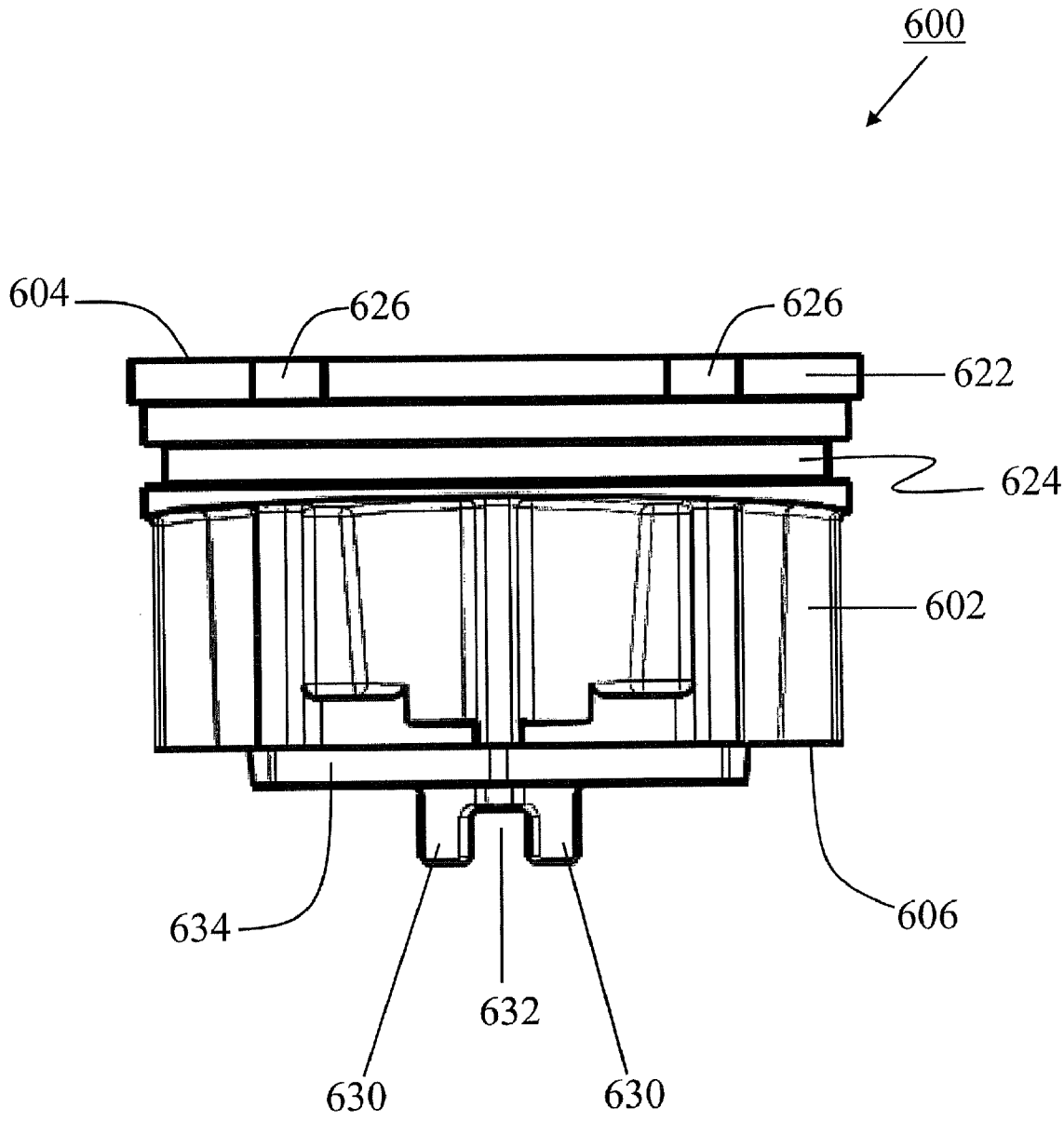
Figure 6C:
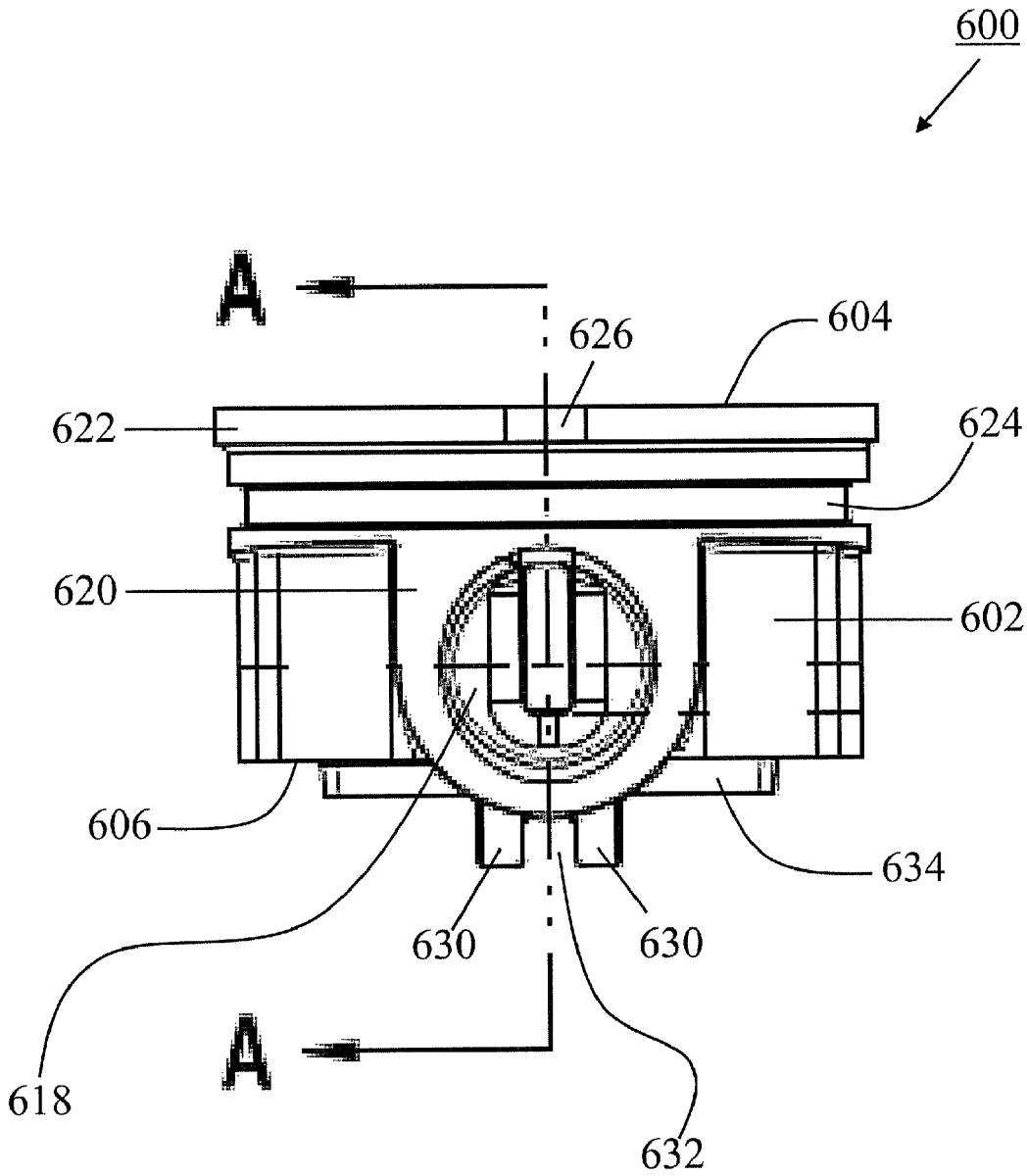
Figure 6D:
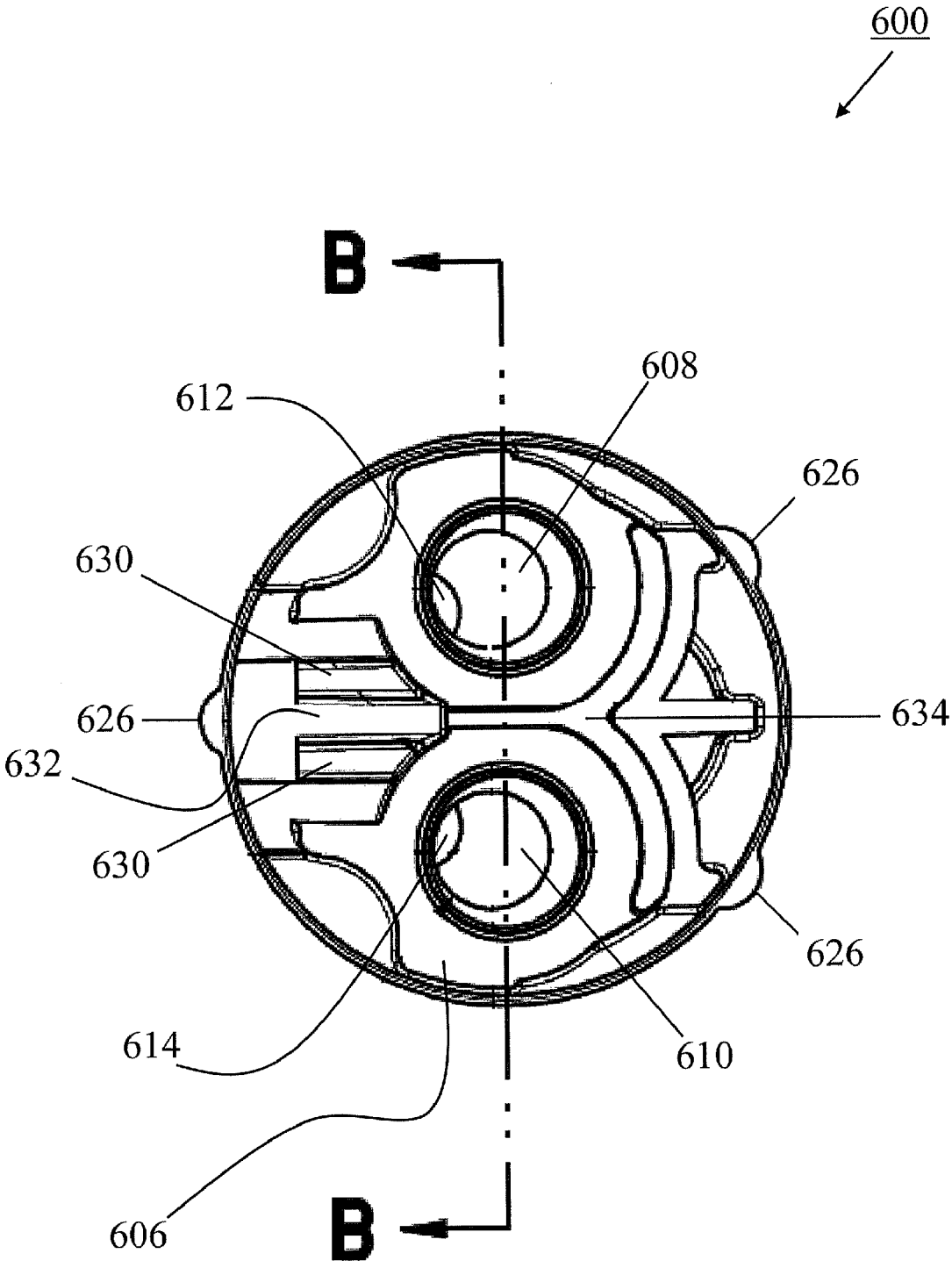
Figure 6E:
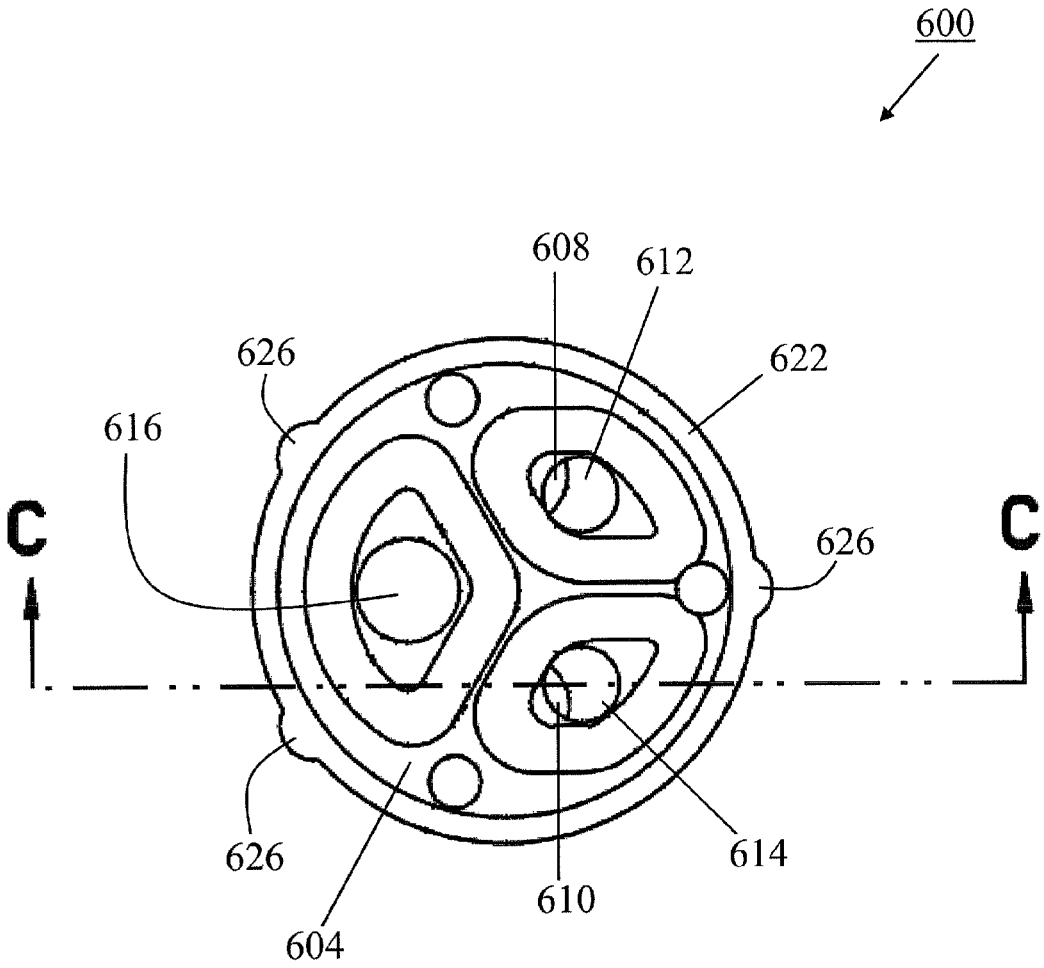
Figure 6F:
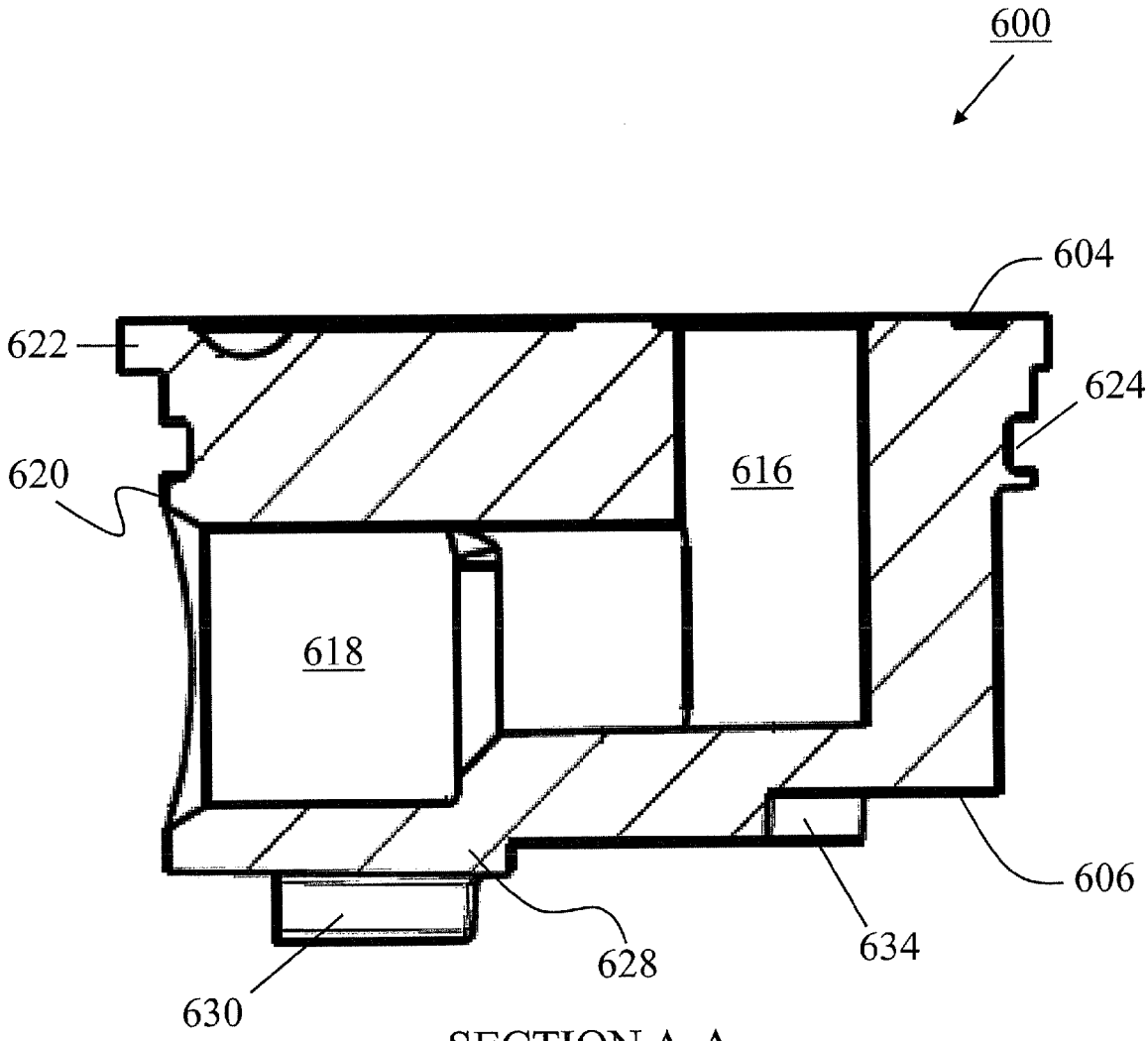
Figure 6G:
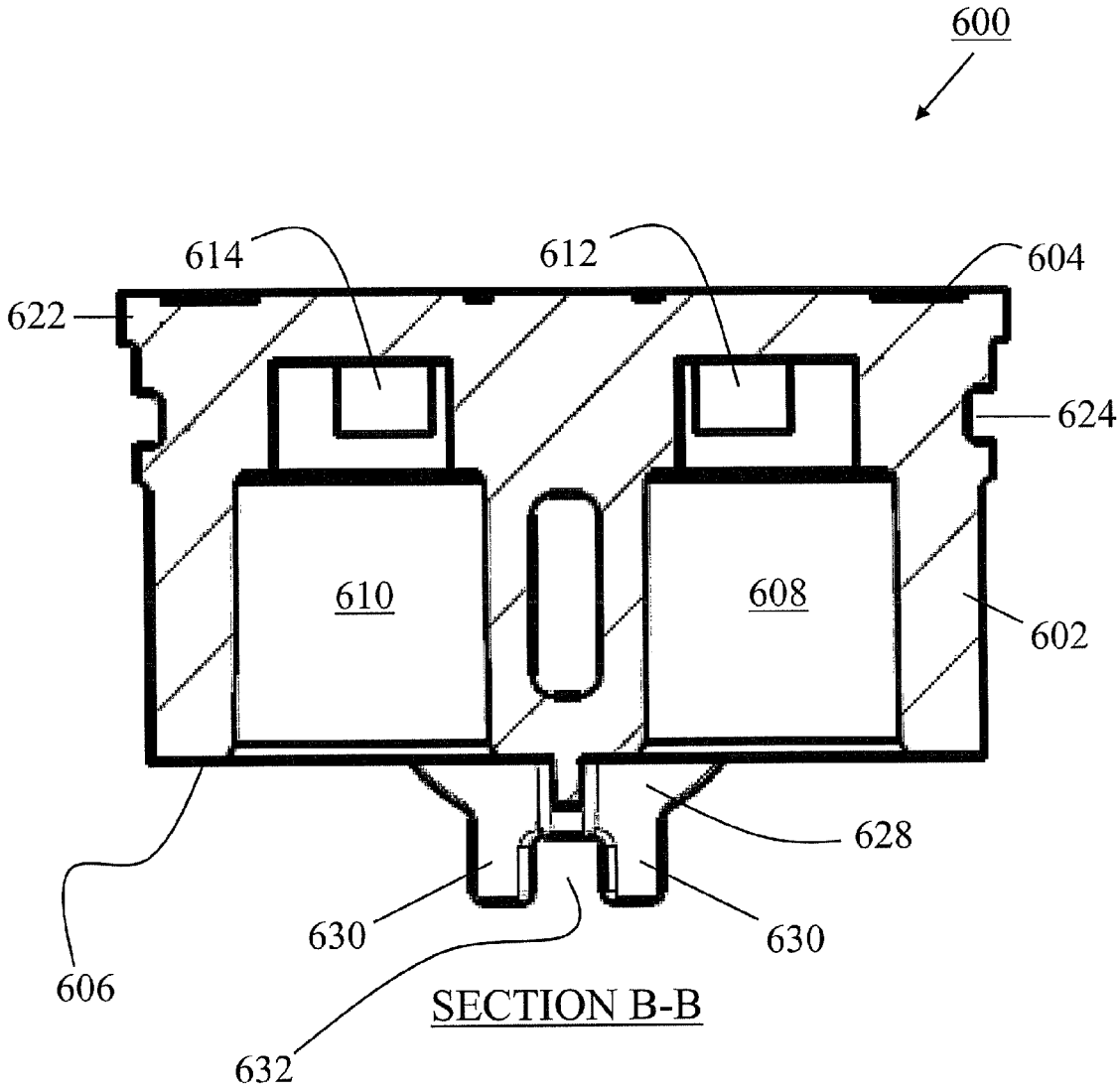
Figure 6H:
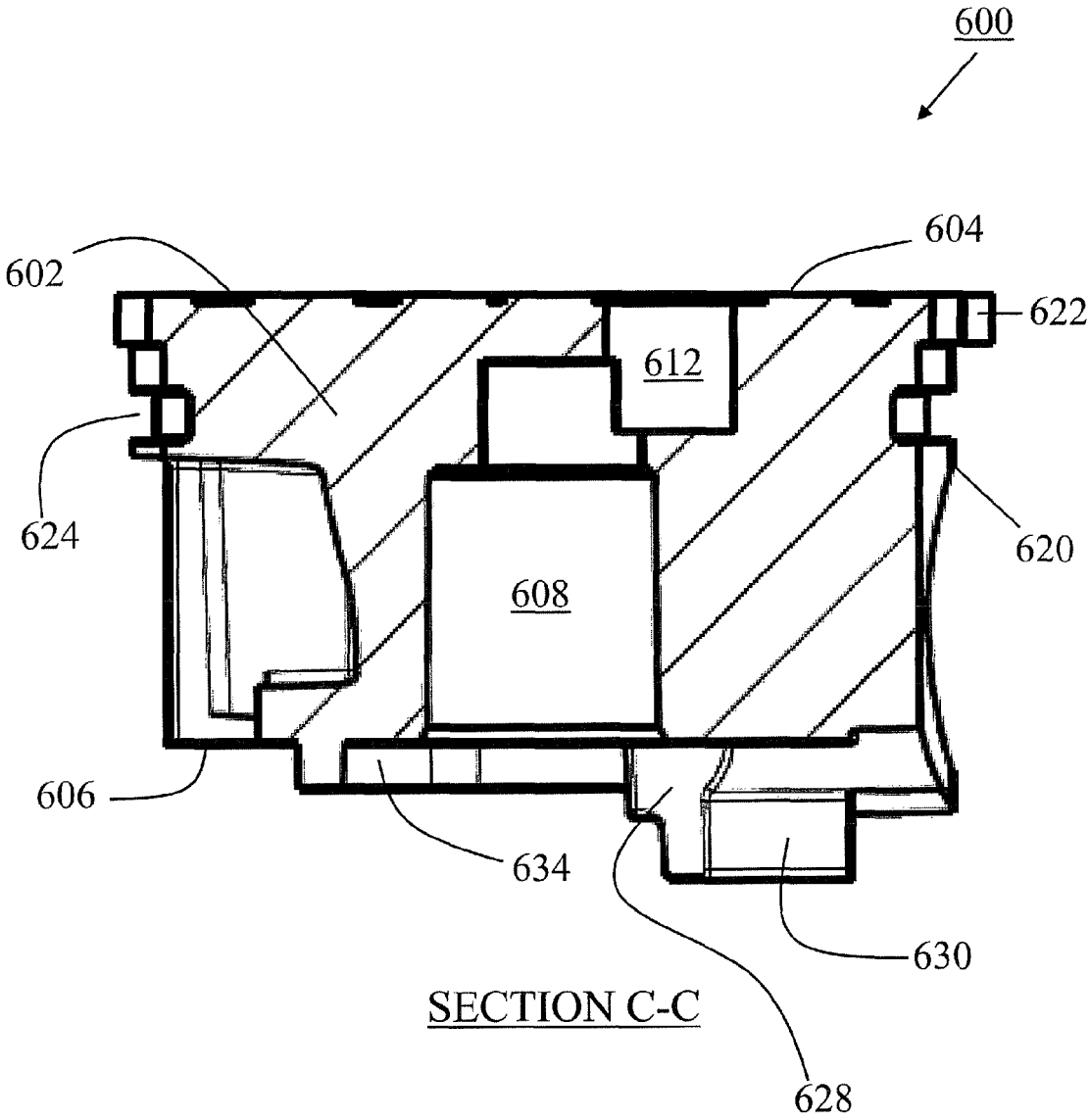

As shown in FIG. 5, the cartridge seat 500 is a two-piece structure having an upper member 600 (see FIGS. 6A-6H) and a lower member 700 (see FIGS. 7A-7D). The upper member 600 and the lower member 700 interface (e.g., fit together) to form the cartridge seat 500. The cartridge seat 500 can be made, for example, of metal and/or plastic. In one exemplary embodiment, the upper member 600 is made of plastic, using a molding process, and the lower member 700 is made of brass, using a forging process.

The upper member 600 interfaces with (e.g., supports) the valve cartridge 124 within the spout upper body 108. The upper member 600 is a one-piece body 602 having an upper surface 604 and a lower surface 606 (see FIGS. 6A-6C and 6F-6H). A lower cold water passage 608 and a lower hot water passage 610 both extend from the lower surface 606 of the body 602 toward the upper surface 604 of the body 602. An upper cold water passage 612 and an upper hot water passage 614 both extend from the upper surface 604 of the body 602 toward the lower surface 606 of the body 602. The upper cold water passage 612 and the upper hot water passage 614 are in fluid communication with the lower cold water passage 608 and the lower hot water passage 610, respectively (see FIGS. 6G-6H). The upper surface 604 of the body 602 also includes a mixed water inlet passage 616 that is in fluid communication with a mixed water outlet passage 618 formed in a side surface 620 of the body 602 (see FIGS. 6C and 6F).

A diameter of the body 602 is largest near the upper surface 604, such that a flange portion 622 is formed near the upper surface 604 (see FIGS. 6B-6C and 6F-6H). A groove 624 formed between the flange portion 622 and the mixed water outlet passage 618 is sized to receive the O-ring 164.

The body 602 can have structure for orienting the cartridge seat 500 within the spout upper body 108. In one exemplary embodiment, a plurality of keys 626 extend outward from the flange portion 622 of the body 602 (see FIGS. 6A-6E). The keys 626 interface with corresponding keyways (not shown) in the spout upper body 108 to prevent rotation and/or insure alignment of the cartridge seat 500 relative to the spout upper body 108.

A projection 628 extends from the lower surface 606 of the body 602 away from the upper surface 604 of the body 602 (see FIGS. 6A and 6F-6H). The projection 628 includes a pair of parallel fingers 630 which are separated by a gap 632. A ridge 634 also extends from the lower surface 606 of the body 602 away from the upper surface 604 of the body 602.

The lower member 700 interfaces with (e.g., receives ends of) the water supply hoses 154 and 156 within the spout upper body 108. The lower member 700 is a one-piece body 702 having an upper surface 704 and a lower surface 706 (see FIGS. 7B and 7D). A cold water passage 708 and a hot water passage 710 both extend from the lower surface 706 of the body 702 to the upper surface 704 of the body 702 (see FIGS. 7A and 7C-7D). The cold water passage 708 and the hot water passage 710 are sized to receive the ends of the cold water supply hose 154 and the hot water supply hose 156, respectively. The cold water passage 708 and the hot water passage 710 are at least partially aligned with the lower cold water passage 608 and the lower hot water passage 610, respectively, when the lower member 700 interfaces with the upper member 600.

A first recess 712 is formed in the body 702 (see FIGS. 7A-7D). The first recess 712 extends from the upper surface 704 towards the lower surface 706 of the body 702. The first recess 712 of the body 702 has a shape that corresponds to a shape of the ridge 634 of the body 602.

Figure 7A:
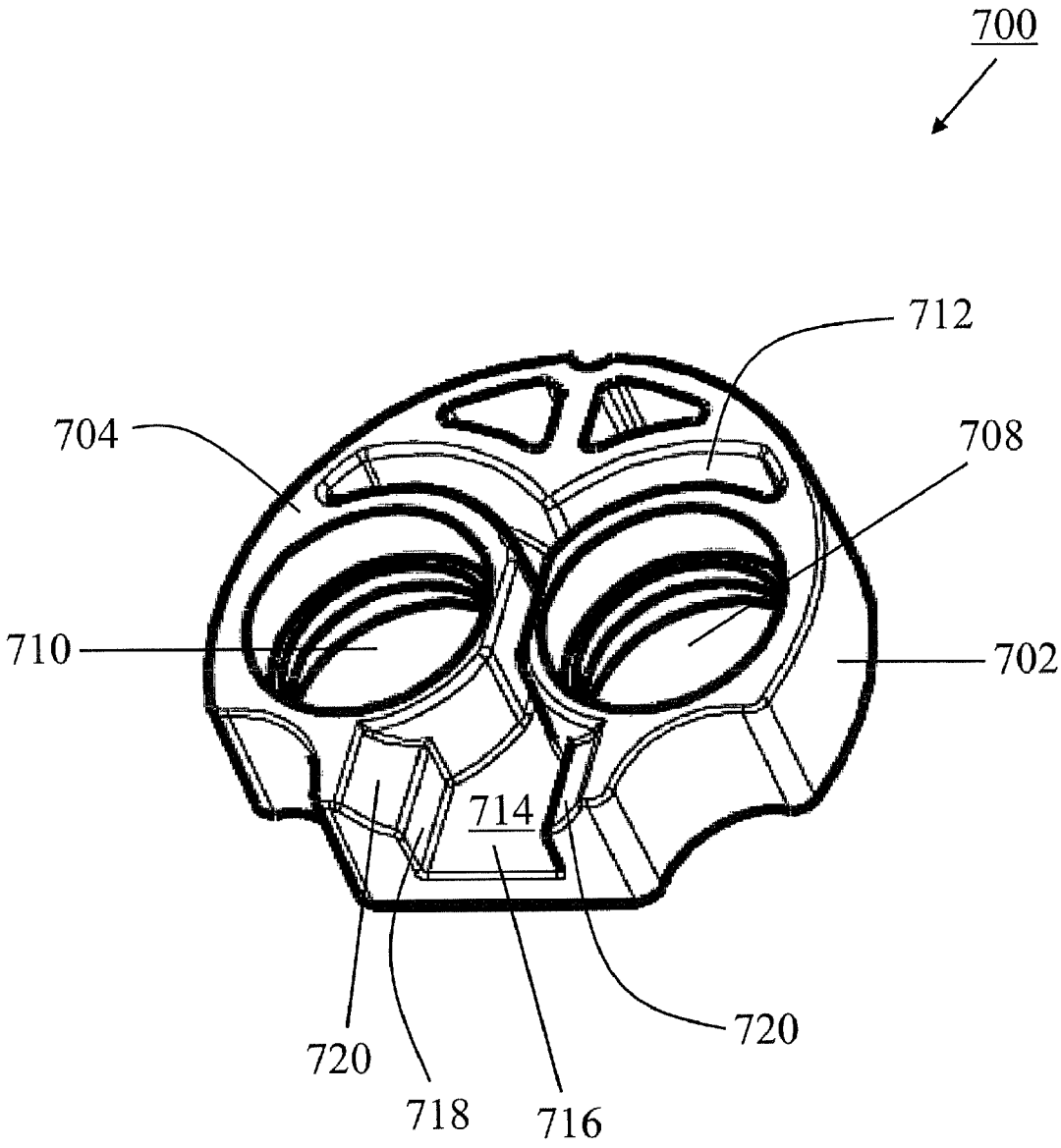
FIGS. 7A-7D show a lower member, according to one exemplary embodiment, for use in the cartridge seat shown in FIG. 5.
Figure 7B:
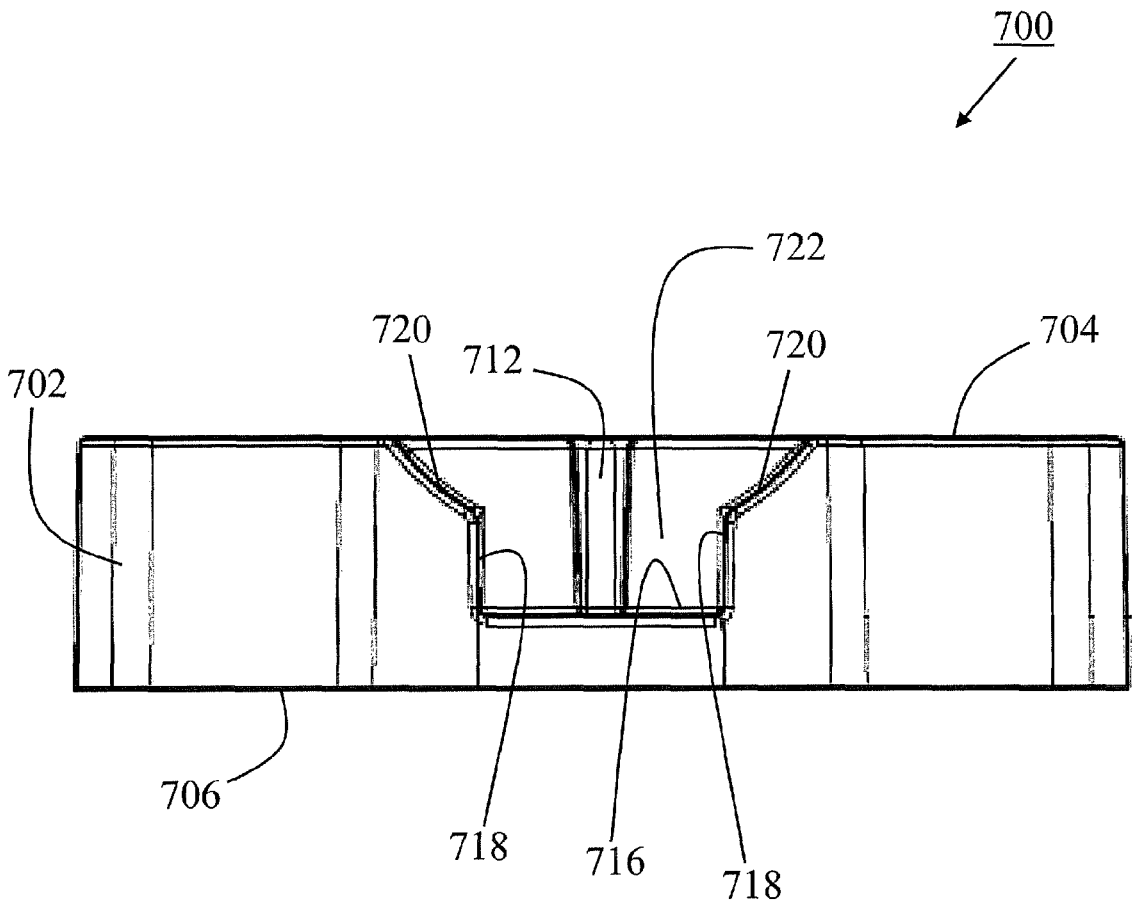
Figure 7C:
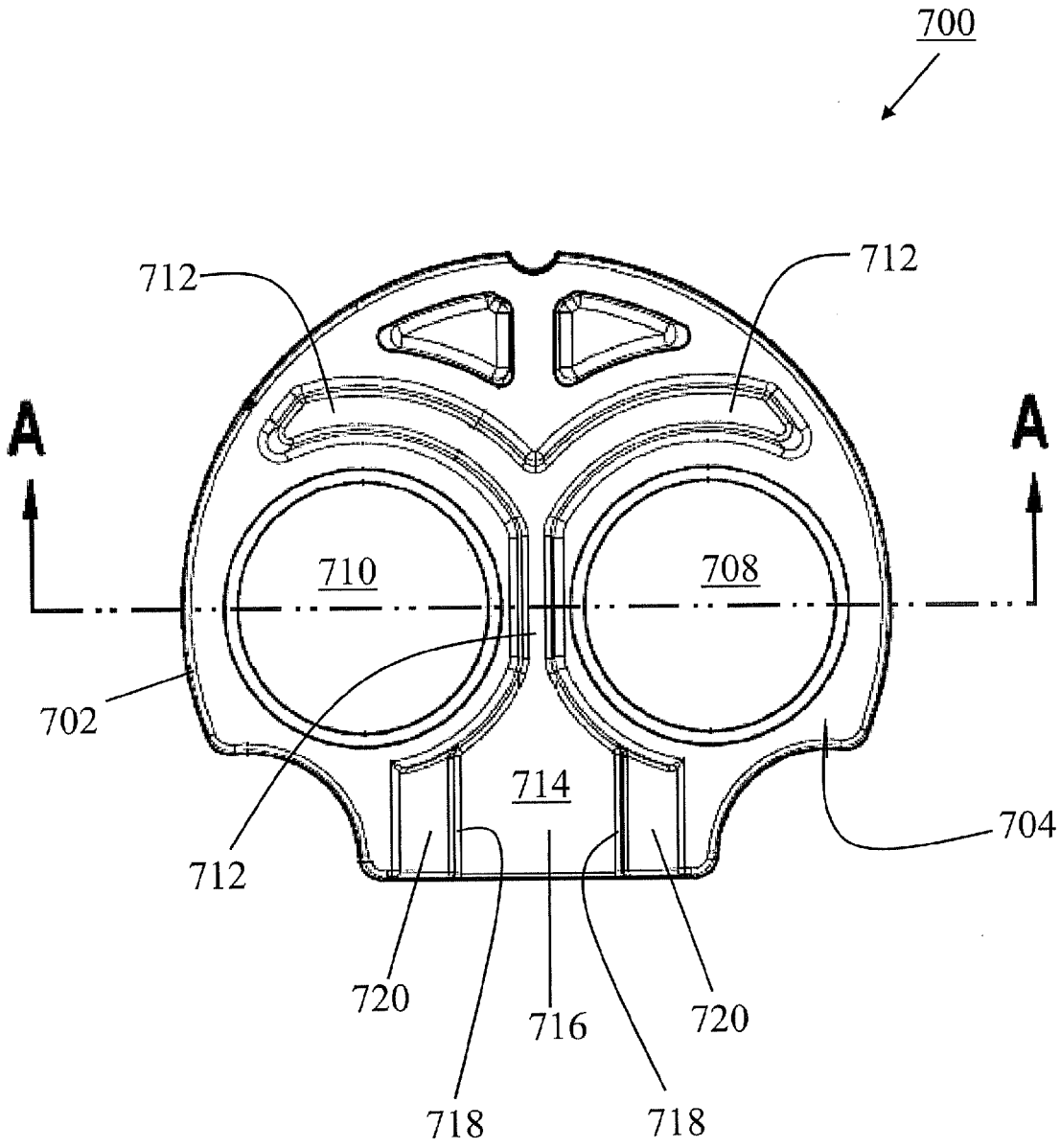
Figure 7D:
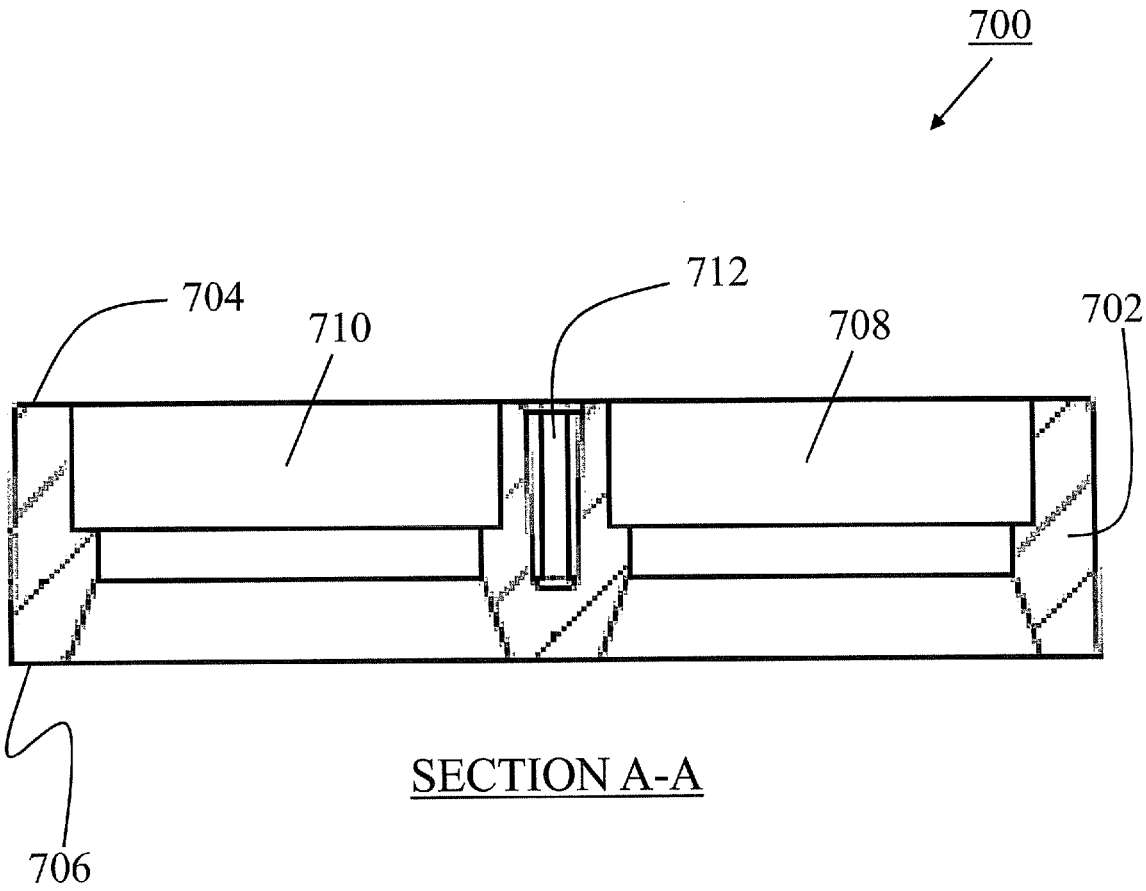

A second recess 714 is also formed in the body 702 (see FIGS. 7A and 7C). The second recess 714 extends from the upper surface 704 towards the lower surface 706 of the body 702. In one exemplary embodiment, the first recess 712 and the second recess 714 are connected. The second recess 714 includes a flat portion 716, a pair of walls 718, and a pair of sloped portions 720 (see FIGS. 7A-7C). The walls 718 and the sloped portions 720 are on opposite sides of the flat portion 716. The flat portion 716 and the walls 718 surround a space 722 (see FIG. 7B).

As noted above, the upper member 600 interfaces with the lower member 700 to form the cartridge seat 500. For example, the ridge 634 of the upper member 600 interfaces with (e.g., fits in) the first recess 712 of the lower member 700. In one exemplary embodiment, the ridge 634 friction fits in the first recess 712. In one exemplary embodiment, the ridge 634 fits in the first recess 712 in only one orientation of the upper member 600 relative to the lower member 700. The projection 628 of the upper member 600 interfaces with (e.g., fits in) the second recess 714 of the lower member 700. For example, the fingers 630 of the body 602 fit in the space 722 of the body 702. The sloped portions 720 of the second recess 714 can guide the fingers 630 of the projection 628 into the space 722. In one exemplary embodiment, the fingers 630 flex toward one another to friction fit into the space 722. Thus, at least one of the interface between the ridge 634 and the first recess 712 and the interface between the projection 628 and the second recess 714 secures the upper member 600 and the lower member 700 together to form the cartridge seat 500. Thereafter, the cartridge seat 500 can be assembled into the faucet assembly 100 as described above for the cartridge seat 200.

In view of the above, the faucet assembly 100 can represent a simpler and/or less expensive architecture than similar conventional faucet assemblies. For example, fewer parts are used in the faucet assembly 100. Unlike typical waterways, the waterway 300 is a one-piece body. A gas-assisted molding process can be used to make the waterway 300 having the desired shape (e.g., curvature) and features (e.g., the straight portion 304, the annular flange 306). The waterway 300 is mounted in the faucet assembly 100 without using any dedicated fasteners or connectors, such as screws or brackets. Instead, the waterway 300 is mounted in the faucet assembly 100 using existing components of the faucet assembly 100, such as the cartridge seat 200 or 500, the spout upper body 108, and/or the aerator 400.

Because the water flow components (i.e., the water supply hoses 154 and 156, the cartridge seat 200 or 500, the valve cartridge 124, the waterway 300, and the aerator 400) are all mounted to the spout upper body 108 only, the water flow components do not need to be manually positioned and/or held during the interfacing of the spout upper body 108 and the spout lower body 110, thereby simplifying assembly of the spout body 174. Furthermore, the faucet assembly 100 (e.g., the water flow path) can be tested before the spout lower body 110 is interfaced with the spout upper body 108.

As noted above, the reliability of the faucet assembly 100 can be improved, for example, by inclusion of the O-ring 164 on the cartridge seat 200 or 500. The O-ring 164 acts as a redundant seal to prevent water leaking below the mounting surface (e.g., the deck 106) in the event that the valve cartridge 124 fails.

The above description of specific embodiments has been given by way of example. From the disclosure given, those skilled in the art will not only understand the general inventive concepts and attendant advantages, but will also find apparent various changes and modifications to the structures and methods disclosed. It is sought, therefore, to cover all such changes and modifications as fall within the spirit and scope of the general inventive concepts, as defined by the appended claims, and equivalents thereof.

What is claimed is:

1. A faucet comprising:

an upper shell and a lower shell, the upper shell and the lower shell being operable to interface to form a spout body;

a cartridge seat;

a spout tube operable to be secured to the upper shell; and an aerator operable to interface with the upper shell, said aerator including a threaded portion for interfacing with a complementary threaded portion formed in the upper shell, wherein the spout tube is operable to interface with the cartridge seat so that the spout tube and the cartridge seat are in fluid communication, wherein interfacing the spout tube with the cartridge seat is operable to secure the spout tube to the upper shell, and wherein interfacing the aerator with the upper shell is operable to further secure the spout tube to the upper shell.

2. The faucet of claim 1, wherein the cartridge seat is a one-piece body operable to be secured to the upper shell.

3. The faucet of claim 1, wherein the cartridge seat is operable to interface with a valve cartridge so that the cartridge seat and the valve cartridge are in fluid communication.

4. The faucet of claim 3, wherein the valve cartridge includes a first seal member, wherein the cartridge seat includes a second seal member, and wherein the second seal member is operable to prevent leakage of water in the event the first seal member fails.

5. The faucet of claim 1, wherein an end of the spout tube friction fits into an opening in the cartridge seat.

6. The faucet of claim 5, wherein the end of the spout tube includes a recess for receiving a seal member.

7. The faucet of claim 1, wherein the spout tube is a one-piece body.

8. The faucet of claim 7, wherein the spout tube is made entirely of plastic.

9. The faucet of claim 8, wherein the spout tube is formed using a gas-assisted molding process.

10. The faucet of claim 1, wherein the spout tube is operable to interface directly with the upper shell, and wherein interfacing the spout tube with the upper shell further secures the spout tube to the upper shell.

11. The faucet of claim 7, wherein the spout tube is a hollow body having a straight portion at a first end and an annular flange at a second end, and a generally curved portion extending between the first end and the second end.

12. The one-piece spout tube of claim 11, wherein the straight portion of the hollow body is operable to interface with the cartridge seat of the faucet.

13. The one-piece spout tube of claim 12, wherein the interface between the straight portion of the hollow body and the cartridge seat of the faucet is one of a friction fit and a snap fit.

14. The one-piece spout tube of claim 11, wherein the annular flange of the hollow body is operable to interface with at least a portion of a housing of the faucet.

15. The one-piece spout tube of claim 14, wherein the interface between the annular flange of the hollow body and the housing of the faucet is one of a friction fit and a snap fit.

* * * * *